US006722688B2

(12) United States Patent
Poscich

(10) Patent No.: US 6,722,688 B2
(45) Date of Patent: Apr. 20, 2004

(54) SNOWBOARD BINDING SYSTEM

(75) Inventor: Douglas V. Poscich, Hinesburg, VT (US)

(73) Assignee: The Burton Corporation, Burlington, VT (US)

( * ) Notice: Subject to any disclaimer, the term of this patent is extended or adjusted under 35 U.S.C. 154(b) by 0 days.

(21) Appl. No.: 09/990,581

(22) Filed: Nov. 21, 2001

(65) Prior Publication Data

US 2003/0094789 A1 May 22, 2003

(51) Int. Cl.[7] ..... A63C 9/99

(52) U.S. Cl. ..... 280/618; 280/624; 280/14.22; 280/613; 280/626

(58) Field of Search ..... 280/618, 624, 280/613, 617, 623, 626, 633, 11.36, 11.33, 616, 14.22, 7.12

(56) References Cited

U.S. PATENT DOCUMENTS

| | | | |
|---|---|---|---|
| 3,398,969 | A | 8/1968 | Perry |
| 3,538,627 | A | 11/1970 | Labat-Camy |
| 3,578,349 | A | 5/1971 | Edmund |
| 3,636,642 | A | 1/1972 | Walther |
| 3,677,566 | A | 7/1972 | Lawrence |
| 3,731,943 | A | 5/1973 | Wilkes |
| 3,775,866 | A | 12/1973 | Marker |
| 3,964,758 | A | 6/1976 | Kent |
| 4,021,056 | A | 5/1977 | Oakes |
| 4,097,062 | A | 6/1978 | Salomon |
| 4,168,085 | A | 9/1979 | Faulin |
| 4,177,584 | A | 12/1979 | Beyl |

(List continued on next page.)

FOREIGN PATENT DOCUMENTS

| | | |
|---|---|---|
| DE | 92 16 831.0 U1 | 5/1993 |
| DE | 43 33 503 C2 | 4/1995 |
| DE | 44 35 960 C1 | 3/1996 |

(List continued on next page.)

*Primary Examiner*—Brian L. Johnson
*Assistant Examiner*—J. Allen Shriver
(74) *Attorney, Agent, or Firm*—Wolf, Greenfield & Sacks, P.C.

(57) ABSTRACT

A snowboard binding system that incorporates the riding performance of a strap binding with the convenience of a step-in binding. The binding system includes a binding interface that is configured to be coupled to a step-in binding base, while also being configured to secure a snowboard boot in a manner that provides a rider with the riding performance of a strap binding. The binding interface may include one or more straps for securing a boot to a snowboard. The binding system may be configured so that the binding base engages regions of the binding interface to which the straps are attached to provide the feel of a strap binding. The binding base may include at least three engagement members to engage with corresponding mating features on the interface. The binding base may include a pair of engagement members at both the rear or heel end and the front or toe end thereof to engage with corresponding mating features on the interface. The engagement members at the heel end of the binding base may be configured to move independently of the engagement members at the toe end of the binding base to facilitate stepping the interface into and out of the binding base. The binding may be provided with a locking arrangement that reduces the likelihood of a false locking condition between the interface and binding by prohibiting at least one of the pairs of engagement members from becoming locked until each of the pair of engagement members assumes its closed position. The binding may be provided with a locking arrangement that maintains each of a pair of engagement members in each of a plurality of closed positions to secure a corresponding pair of mating features. The binding interface may have a lower portion with a X-shape configuration to be mounted below a boot sole.

118 Claims, 15 Drawing Sheets

U.S. PATENT DOCUMENTS 4,278,269 A 7/1981 Beyl
4,353,574 A 10/1982 Faulin
4,403,789 A 9/1983 Hickey
4,570,363 A 2/1986 Annovi
4,624,474 A 11/1986 Klubitschko et al.
4,647,065 A 3/1987 Stritzl et al.
4,657,277 A 4/1987 Haldemann et al.
4,703,946 A 11/1987 Nava
4,722,613 A 2/1988 Jungkind
4,728,115 A 3/1988 Pozzobon et al.
4,846,492 A 7/1989 Bataille
4,858,946 A 8/1989 Stritzl et al.
4,915,407 A 4/1990 Brischoux
4,969,655 A 11/1990 Katz
4,973,073 A 11/1990 Raines et al.
5,020,823 A 6/1991 Bogner
5,024,457 A 6/1991 Bogner
5,035,443 A * 7/1991 Kincheloe ..... 280/14.22
5,046,382 A 9/1991 Steinberg
5,086,576 A 2/1992 Lamson
5,125,173 A 6/1992 Nagano et al.
5,131,291 A 7/1992 Beyl
5,142,798 A 9/1992 Kaufman et al.
5,145,202 A 9/1992 Miller
5,156,644 A 10/1992 Koehler et al.
5,170,574 A 12/1992 Weisbrich
5,203,229 A 4/1993 Chen
5,265,901 A 11/1993 Gorza
5,277,635 A 1/1994 Gillis
5,299,823 A 4/1994 Glaser
5,342,078 A 8/1994 Stepanek et al.
5,354,088 A 10/1994 Vetter et al.
5,356,170 A 10/1994 Carpenter et al.
5,474,322 A 12/1995 Perkins et al.
5,480,176 A 1/1996 Sims
5,505,477 A 4/1996 Turner et al.
5,505,478 A 4/1996 Napoliello
5,520,405 A 5/1996 Bourke
5,520,406 A 5/1996 Anderson et al.
5,522,282 A 6/1996 Nagano
5,544,909 A 8/1996 Laughlin et al.
5,553,883 A * 9/1996 Erb ..... 280/14.24
5,557,985 A 9/1996 Nagano
5,558,355 A 9/1996 Henry
5,577,757 A 11/1996 Riepl et al.
5,595,396 A 1/1997 Bourdeau
D382,320 S 8/1997 Sand
5,660,410 A 8/1997 Alden
5,664,344 A 9/1997 Marmonier
5,669,630 A 9/1997 Perkins et al.
5,690,350 A 11/1997 Turner et al.
5,690,351 A 11/1997 Karol
5,695,210 A 12/1997 Goss et al.
5,697,631 A 12/1997 Ratzek et al.
5,699,699 A 12/1997 Nagano
5,701,689 A 12/1997 Hansen et al.
5,704,139 A 1/1998 Okajima
5,713,587 A 2/1998 Morrow et al.
5,727,797 A 3/1998 Bowles
5,771,609 A 6/1998 Messmer
5,782,476 A 7/1998 Fardie
5,799,957 A 9/1998 Okajima et al.
5,806,876 A 9/1998 Alden
5,813,689 A * 9/1998 Mansure ..... 280/14.21
5,815,952 A 10/1998 Bobrowicz
5,815,953 A 10/1998 Kaufman et al.
5,820,155 A 10/1998 Brisco
5,826,910 A 10/1998 Ricks et al.
5,845,421 A 12/1998 Tanaka
5,857,700 A 1/1999 Ross
5,871,226 A 2/1999 Klubitschko et al.
5,887,886 A 3/1999 Bourdeau
5,890,730 A 4/1999 Anderson et al.
5,899,483 A 5/1999 Paris
5,899,484 A 5/1999 Paradis
5,927,744 A 7/1999 Knapschafer
5,941,553 A 8/1999 Korman
5,947,488 A 9/1999 Gorza et al.
5,954,358 A 9/1999 Bejean et al.
5,967,531 A 10/1999 Saillet
5,971,407 A 10/1999 Zemke et al.
5,971,422 A 10/1999 Anderson et al.
5,975,556 A 11/1999 Lehman
6,007,077 A 12/1999 Moe
6,010,138 A 1/2000 Bobrowicz et al.
6,029,991 A * 2/2000 Frey ..... 280/613
6,053,524 A 4/2000 Laughlin
6,056,312 A * 5/2000 Hogstedt ..... 280/14.24
6,076,848 A 6/2000 Rigal et al.
RE36,800 E * 8/2000 Vetter et al. ..... 280/618
6,099,018 A * 8/2000 Maravetz et al. ..... 280/14.24
6,102,429 A 8/2000 Laughlin et al.
6,102,430 A 8/2000 Reynolds
6,109,643 A 8/2000 Bayer et al.
6,116,634 A 9/2000 Mometti
6,123,354 A 9/2000 Laughlin et al.
6,126,179 A 10/2000 Dodge
6,164,682 A 12/2000 Okajima et al.
6,195,919 B1 3/2001 Forrest et al.
6,196,559 B1 3/2001 Cress
6,196,569 B1 3/2001 Berger et al.
6,199,893 B1 3/2001 Fumagalli
6,203,052 B1 3/2001 Dodge
6,206,403 B1 3/2001 Black et al.
6,209,890 B1 * 4/2001 Couderc ..... 280/14.22
6,213,493 B1 4/2001 Korman
6,227,552 B1 5/2001 Keller et al.
6,276,708 B1 * 8/2001 Hogstedt ..... 280/14.22
6,322,096 B2 11/2001 Porte
6,347,805 B1 * 2/2002 Maravetz et al. ..... 280/14.22
6,390,492 B1 * 5/2002 Bumgarner et al. ..... 280/607
6,402,164 B1 * 6/2002 Gonthier ..... 280/14.22
6,416,074 B1 * 7/2002 Maravetz et al. ..... 280/613
6,595,542 B2 7/2003 Okajima
2001/0010422 A1 * 8/2001 Merino et al. ..... 280/624
2002/0008366 A1 * 1/2002 Rittmeyer ..... 280/613
2002/0043783 A1 * 4/2002 Okajima et al. ..... 280/613
2002/0089150 A1 * 7/2002 Musho et al. ..... 280/613

FOREIGN PATENT DOCUMENTS

DE 296 08 660 U1 9/1996
DE 196 02 667 10/1997
EP 0 217 750 A1 4/1987
EP 0 615 774 A2 9/1994
EP 0 668 090 A1 8/1995
EP 0 719 505 A3 7/1996
EP 0 740 908 A1 11/1996
EP 0 743 023 A1 11/1996
EP 0 753 269 A1 1/1997
EP 0 774 217 A2 5/1997
EP 0 793 920 A1 9/1997
EP 0 796 570 A1 9/1997
EP 0 838 248 A1 4/1998
FR 2 592 807 A1 7/1987
FR 2 604 913 A1 4/1988
FR 2 627 993 A1 9/1989
FR 2 720 655 A1 12/1995
FR 2 732 230 A1 10/1996
FR 2 752 685 A1 3/1998
IT 322456 11/1934
JP 9-248360 9/1997

| | | | |
|---|---|---|---|
| WO | WO 80/00063 | A1 | 1/1980 |
| WO | WO 94/26365 | A1 | 11/1994 |
| WO | WO 95/09035 | A1 | 4/1995 |
| WO | WO 95/33534 | A1 | 12/1995 |
| WO | WO 96/01575 | A1 | 1/1996 |
| WO | WO 96/17660 | A1 | 6/1996 |
| WO | WO 96/22137 | | 7/1996 |
| WO | WO 96/26774 | A1 | 9/1996 |
| WO | WO 96/36407 | A1 | 11/1996 |
| WO | WO 97/03734 | A1 | 2/1997 |
| WO | WO 97/22390 | A1 | 6/1997 |
| WO | WO 97/27773 | A1 | 8/1997 |
| WO | WO 97/31689 | A1 | 9/1997 |
| WO | WO 98/01193 | A1 | 1/1998 |
| WO | WO 98/06465 | A1 | 2/1998 |
| WO | WO 98/07479 | A1 | 2/1998 |
| WO | WO 98/39069 | A1 | 9/1998 |
| WO | WO 02/092176 | A1 | 11/2002 |

* cited by examiner

SNOWBOARD BINDING SYSTEM

FIELD OF THE INVENTION

The present invention is directed generally to the field of bindings for gliding sports, and more particularly to the field of snowboard bindings.

BACKGROUND OF THE INVENTION

Snowboard binding systems used with soft snowboard boots typically are classified as one of two general types. A strap binding typically includes one or more straps that extend across a rider's boot to secure the boot to the binding. In contrast, a step-in binding typically employs one or more strapless engagement members, rather than straps, into which the rider can step to lock the boot into the binding. The strapless engagement members are configured to engage with one or more corresponding engagement members on the boot.

A strap binding typically delivers a feel or performance many riders find desirable. More particularly, a strap binding allows a rider's foot to roll laterally when riding by allowing the boot to roll relative to the binding. Some riders, however, may find a strap binding inconvenient because a rider must unbuckle each strap of the rear binding after each run to release the rear boot when getting on a lift, and must subsequently re-buckle each strap before the next run.

A step-in binding avoids the need to unbuckle and re-buckle straps each time a rider needs to release a boot from the binding. Many riders, however, find conventional step-in bindings undesirable for several reasons. First, most step-in bindings fail to deliver the desirable feel or performance associated with a strap binding. Rather, conventional step-in binding systems typically employ a rigid interface between the boot and binding that does not allow foot roll since the boot is rigidly attached to the binding. Second, a soft snowboard boot configured for use with a step-in binding typically requires a more rigid sole, as compared to a soft boot for a strap binding. Additionally, in many step-in systems, a rigid interface is attached to the sole of the boot, further reducing the comfort of the boot when walking.

It is an object of the present invention to provide an improved binding system for engaging a snowboard boot to a snowboard.

SUMMARY OF THE INVENTION

One embodiment of the present invention is directed to a binding system for securing a snowboard boot to a snowboard. The binding system comprises a binding interface and a snowboard binding base. The binding interface includes an interface body including medial and lateral sides with first and second regions provided along each of the medial and lateral sides, a first strap attached to the first region of the interface body and a second strap attached to the second region of the interface body. The first and second straps are constructed and arranged to extend across first and second portions of the snowboard boot, forward of a heel portion thereof, to secure the binding interface to the snowboard boot. The snowboard binding base includes a base body, which has a heel end and a toe end, to be mounted to the snowboard. The snowboard binding base further includes at least one strapless engagement member, supported by the base body, that is to engage the binding interface at each of the first and second regions of the interface body along both the medial and lateral sides. A highback is is supported at the heel end of the base body.

A further embodiment of the present invention is directed to a binding system for securing a snowboard boot to a snowboard. The binding system comprises a binding interface and a snowboard binding base. The binding interface includes an interface body, at least three mating features supported by the interface body, and first and second straps, supported by the interface body, to secure the binding interface to the snowboard boot. The first and second straps are constructed and arranged to extend across first and second portions of the snowboard boot forward of a heel portion thereof. The snowboard binding base includes a base body, which has a heel end and a toe end, to be mounted to the snowboard. The snowboard binding base further includes at least three engagement members, supported by the base body, that are adapted to engage the mating features of the binding interface. A highback is supported at the heel end of the base body.

Another embodiment of the present invention is directed to a binding system for securing a snowboard boot to a snowboard. The binding system comprises a binding interface and a snowboard binding base. The binding interface includes an interface body having a toe end and a heel end, a pair of first mating features supported at the heel end of the interface body, a pair of second mating features supported at the toe end of the interface body, and at least one strap, supported by the interface body, to secure the binding interface to the snowboard boot. The snowboard binding base includes a base body to be mounted to the snowboard. The base body has a toe end and a heel end, and a highback supported at the heel end of the base body. The snowboard binding base also includes a pair of first engagement members, each of the pair of first engagement members being movably supported at the heel end of the base body between at least one closed position to engage a corresponding one of the pair of first mating features of the interface and an open position to release the corresponding one of the pair of first mating features. The snowboard binding base further includes a pair of second engagement members supported at the toe end of the base body to engage the pair of second mating features of the interface.

A further embodiment of the present invention is directed to a binding system for securing a snowboard boot to a snowboard. The binding system comprises a binding interface and a snowboard binding base. The binding interface includes an interface body having a toe end, a heel end and lateral and medial sides, a pair of first mating features, one each supported along the lateral and medial sides of the interface body, a pair of second mating features, one each supported along the lateral and medial sides of the interface body, and at least one strap supported by the interface body to secure the binding interface to the snowboard boot. The snowboard binding base includes a base body to be mounted to the snowboard. The base body has lateral and medial sides, and a highback supported at the heel end of the base body. The snowboard binding base also includes a pair of first engagement members, one each movably supported along the lateral and medial sides of the base body between at least one closed position to engage a corresponding one of the pair of first mating features of the interface and an open position to release the corresponding one of the pair of first mating features. The snowboard binding base further includes a pair of second engagement members that are independent of the pair of first engagement members. One each of the pair of second engagement members is supported along the lateral and medial sides of the base body. Each of the pair of second engagement members is adapted to engage a corresponding one of the pair of second mating features of the interface.

Another embodiment of the present invention is directed to a snowboard binding to secure a snowboard boot to a snowboard. The snowboard binding comprises a base including a toe end and a heel end, and a highback supported at the heel end of the base. The snowboard binding also comprises a pair of first engagement members supported by the base, the pair of first engagement members being adapted to engage a pair of first mating features supported along opposing sides of the snowboard boot. Each of the pair of first engagement members is movable between an open position to release a corresponding one of the pair of first mating features and at least one closed position to secure the corresponding one of the pair of first mating features. The snowboard binding further comprises a pair of second engagement members supported by the base, the pair of second engagement members being adapted to receive the snowboard boot therebetween and to engage a pair of second mating features supported along the opposing sides of the snowboard boot. The pair of first engagement members is moveable independently of the pair of second engagement members.

A further embodiment of the present invention is directed to a snowboard binding to secure a snowboard boot to a snowboard. The snowboard binding comprises a base, and a pair of engagement members, supported by the base, to engage a pair of mating features supported by the snowboard boot. Each of the pair of engagement members is movable independently of the other between an open position to release a corresponding one of the pair of mating features and at least one closed position to secure the corresponding one of the pair of mating features. The snowboard binding further comprises a locking mechanism adapted to move between a locking position to maintain each of the pair of engagement members in the at least one closed position and a release position to permit movement of each of the pair of engagement members to the open position. The locking mechanism is movable to the locking position only when each of the pair of engagement members is moved to the closed position.

Another embodiment of the present invention is directed to a binding system for securing a snowboard boot to a snowboard. The binding system comprises a binding interface and a snowboard binding base. The binding interface includes an interface body, at least one pair of mating features supported by the interface body, and at least one strap supported by the interface body to secure the binding interface to the snowboard boot. The snowboard binding base includes a base body including a medial side and a lateral side, the base body to receive a snowboard boot between the medial and lateral sides. The snowboard binding base also includes at least one pair of engagement members to engage the at least one pair of mating features. One each of the pair of engagement members is movably supported on the medial and lateral sides of the base body. Each of the pair of engagement members is movable between an open position to release a corresponding one of the pair of mating features and a plurality of separately lockable closed positions to secure the corresponding one of the pair of mating features. The snowboard binding base further includes a locking mechanism adapted to move between a locking position to maintain each of the pair of engagement members in each of its plurality of closed positions and a release position to permit movement of each of the pair of engagement members to its open position.

A further embodiment of the present invention is directed to an interface for coupling a snowboard boot to a snowboard binding base, the snowboard binding base having a toe end and a heel end and including a highback at the heel end thereof, the snowboard binding base including a pair of first engagement members at the heel end thereof and a pair of second engagement members at the toe end thereof. The interface comprises an interface body having a toe end and a heel end that is free of a highback, a pair of first mating features supported at the heel end of the interface body, the pair of first mating features to be engaged by the pair of first engagement members, and a pair of second mating features supported at the toe end of the interface body, the pair of second mating features to be engaged by the pair of second engagement members. The binding interface further comprises first and second straps supported by the interface body to secure the binding interface to the snowboard boot. The first strap is attached to the heel end of the interface body and the second strap is attached to the toe end of the interface body.

Another embodiment of the present invention is directed to an interface for coupling a snowboard boot to a snowboard binding base, the snowboard boot including a sole, the snowboard binding base having a toe end and a heel end and including at least one first engagement member and at least one second engagement member. The interface comprises an interface body including medial and lateral sides and front and rear edges extending between the medial and lateral sides. The front and rear edges are spaced apart a first distance in a longitudinal direction along a length of the interface body between the medial and lateral sides. The binding interface also comprises at least one first mating feature supported by the interface body and at least one second mating feature supported by the interface body. The at least one first mating feature is to be engaged by the first engagement member and the at least one second mating feature is to be engaged by the second engagement member. The at least one second mating feature is spaced from the at least one first mating feature by a second distance in the longitudinal direction that is greater than the first distance. The binding interface further comprises at least one strap supported by the interface body to secure the binding interface to the snowboard boot.

A further embodiment of the present invention is directed to an interface for coupling a snowboard boot to a snowboard binding base, the snowboard boot including a sole, the snowboard binding base including at least one pair of engagement members. The interface comprises an interface body including a lower portion that is to be mounted below at least a portion of the sole of the snowboard boot. The lower portion has an X-shaped configuration. The binding interface further comprises at least one pair of mating features supported by the interface body to be engaged by the at least one pair of engagement members, and at least one strap supported by the interface body to secure the binding interface to the snowboard boot.

Another embodiment of the present invention is directed to an interface for coupling a snowboard boot to a snowboard binding base, the snowboard binding base including a highback at a heel end thereof, the snowboard binding base including a pair of first engagement members and a pair of second engagement members. The interface comprises an interface body including medial and lateral sides with first and second regions provided along each of the medial and lateral sides. The interface also comprises a pair of first mating features to be engaged by the pair of first engagement members of the snowboard binding base and a pair of second mating features to be engaged by the pair of second engagement members of the snowboard binding base. One each of the pair of first mating features is supported at the first regions along both the medial and lateral sides of the interface body, and one each of the pair of second mating features is supported at the second regions along both the medial and lateral sides of the interface body. The interface further comprises first and second straps constructed and arranged to extend across first and second portions of the snowboard boot, forward of a heel portion thereof, to secure the binding interface to the snowboard boot. The first strap is attached to the first regions of the interface body and the second strap is attached to the second regions of the interface body.

A further embodiment of the present invention is directed to an interface for coupling a snowboard boot to a snowboard binding base, the snowboard binding base having a toe end and a heel end and including a highback at the heel end thereof, the snowboard binding base including at least one pair of engagement members that is movable between an open position and a closed position. The interface comprises an interface body that is free of a highback, at least one pair of mating features supported by the interface body, and at least one strap supported by the interface body to secure the binding interface to the snowboard boot. The at least one pair of mating features is adapted to automatically move the at least one pair of engagement members to the open position, without manual actuation of the at least one pair of engagement members by a rider, when the interface body is stepped into and out of the snowboard binding base.

BRIEF DESCRIPTION OF THE DRAWINGS

The foregoing and other objects and advantages of the invention will be appreciated more fully from the following drawings, wherein like reference characters designate like features, in which.

DETAILED DESCRIPTION

Figure 1:
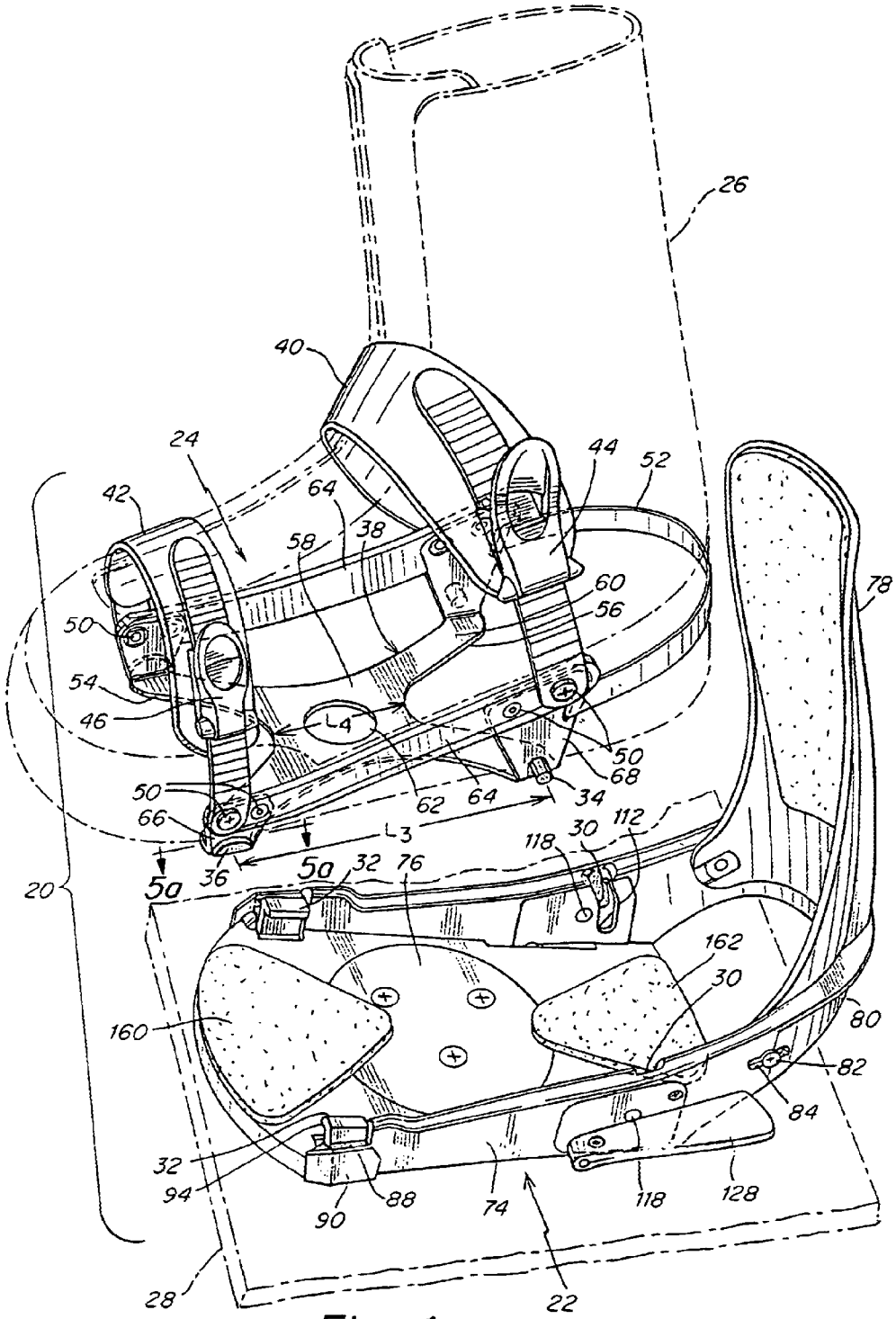
FIG. 1 is an exploded perspective view of a binding system according to one illustrative embodiment of the invention.

The present invention is directed to an improved snowboard binding system that incorporates the riding performance of a strap binding with the convenience of a step-in binding. This may be accomplished with a two-piece binding system that includes: (1) a binding base that includes a highback; and (2) a binding interface that includes one or more straps and is configured to be coupled to the base in a manner similar to a step-in binding. Thus, when the interface is coupled to the binding base, the binding operates like, and provides the performance and feel, of a conventional strap binding. However, between runs, a rider can remove the interface from the binding base with the convenience of a step-in binding (e.g., to negotiate a lift line and get on a chair lift).

One aspect of the binding system is directed to an improved step-in binding. Another aspect of the binding system is directed to a binding interface for coupling a snowboard boot to a snowboard binding base. Although the binding base and the binding interface may be advantageously employed together, the present invention is not limited in this respect, as each of these aspects of the present invention can also be employed separately. For example, the snowboard binding base may be employed to directly engage a snowboard boot, rather than engage a snowboard boot through a separate interface. Similarly, the binding interface may be employed with numerous types of binding bases, and is not limited to use with the illustrative embodiments disclosed herein.

The binding system may be configured so that the binding base engages regions of the binding interface to which one or more straps are attached to provide a feel similar to that of a strap binding. In this regard, each engagement region can include a strap attachment point and a binding mating feature that are positioned relative to each other so that forces exerted on the strap are transmitted through the mating feature to the binding in a manner that achieves a desired feel. Such a system configuration may facilitate the transmission of forces exerted on a strap, through the interface, to the binding base in a manner similar to a conventional strap binding in which forces are transmitted directly to a binding baseplate through a strap mounted directly to the baseplate.

In one embodiment, the binding system may employ a four point engagement between the binding interface and the binding base. Such an arrangement may substantially reduce, if not eliminate, movement between the interface and the binding base so that movement of a boot relative to the binding base may be controlled by the manner in which the boot is secured to the binding base through the interface. The arrangement causes the binding system to have the performance and feel of a strap binding by transmitting forces exerted by a rider to four points of engagement similar to the strap attachment points of a strap binding. This arrangement may also simulate the feel of a strap binding system by allowing structure to be eliminated from below the heel and toe regions of a rider's foot. In this regard, corresponding pairs of interconnect features between the interface and binding base may be arranged along the lateral and medial sides of the boot. It is to be appreciated, however, that other embodiments of the binding system do not employ a four-point engagement configuration.

In one embodiment, the binding interface may be configured with multiple binding straps to deliver a rider with the desired feel associated with strap bindings. In this regard, the interface may include an ankle strap and a toe strap that are arranged to extend across the in-step or ankle portion and the toe portion, respectively, of a rider's foot in a manner similar to a conventional strap binding. The straps may be attached to regions of the interface adjacent the interconnect features between the interface and binding base so that forces exerted by a rider on the straps are transmitted directly to regions of the binding in a manner similar to a conventional strap binding. It is to be understood, however, that other embodiments do not use multiple binding straps. Additionally, other embodiments do not attach the straps adjacent the interconnect features between the interface and the binding base.

In one embodiment, the binding base may include a pair of engagement members at both the rear or heel end and the front or toe end of the binding to engage with corresponding mating features on the interface. The engagement members may be located along regions of the binding base that correspond to the strap attachment points for a conventional strap binding. In other embodiments, the binding base does not employ a pair of engagement members at the heel and toe end. Additionally, other embodiments do not locate the engagement members along regions of the binding base that correspond to the strap attachment points.

In one embodiment, the engagement members at the heel end of the binding base may be configured to move independently of the engagement members at the toe end of the binding base to facilitate stepping the interface into and out of the base. In other embodiments, independent movement is not employed between the engagement members at the heel and toe ends of the binding.

In one embodiment, the binding base may be provided with a locking arrangement that reduces the likelihood of a false locking condition between the interface and binding base by prohibiting at least one of the pairs of engagement members from becoming locked until each of the pair of engagement members assumes its closed position. It is to be appreciated, however, that such a locking arrangement is not employed in all embodiments of the binding base.

In one embodiment, the binding base may be configured to accommodate an accumulation of snow, ice or other debris between the binding base and the interface and/or boot. Other embodiments of the binding base do not accommodate an accumulation of snow, ice or other debris.

In one illustrative embodiment shown in FIGS. 1–4, the binding system 20 includes a binding base 22 and a binding interface 24 that is configured to cooperate with the base to secure a snowboard boot 26 to a snowboard 28. The binding system employs an engagement arrangement between the interface 24 and the base 22 that is configured to simulate the feel and riding performance associated with a strap binding. In this regard, in one embodiment the binding system employs an engagement arrangement in which the interface is attached to the binding base in the region of each strap. For example, when the binding system employs two straps, a four point engagement (two points on each side of the interface and the binding base with each point in a region of one of the straps) is provided between the interface and the base. It is to be appreciated, however, that the binding system may be configured to employ any number of engagement points greater than or less than four engagement points. Furthermore, in other embodiments of the invention, the binding system does not have engagement points. aligned with strap mounting positions.

As illustrated, the binding system includes a pair of opposing engagement members 30 at the rear or heel end of the binding base and a pair of opposing engagement members 32 at the front or toe end of the base that cooperate with pairs of corresponding mating features 34, 36 on the interface 24 to secure the interface to the base. The heel end and the toe end of the binding correspond to regions that are located, respectively, rearward and forward of the arch area of a rider's foot. In one embodiment, the pairs of opposing engagement members are located at the heel and toe ends of the binding base so as to be in the regions where the straps are attached to the interface. It is to be understood, however, that the engagement members may be located in any desirable locations along the binding base.

In the illustrative embodiment of FIGS. 1–4, the binding interface 24 includes an interface body 38 and multiple binding straps that are configured to extend across portions of a snowboard boot to secure the boot to the interface. In one embodiment, the interface includes an ankle strap 40 and a toe strap 42 that are respectively arranged to extend across the ankle and toe portions of a snowboard boot 26 in a manner similar to a conventional strap binding. In this regard, once the binding interface 24 is coupled to the binding base 22, the binding system will deliver a desired feel and riding performance typically associated with a strap binding.

In the illustrative embodiment, the ankle and toe straps 40, 42 each includes a ratchet-type buckle 44, 46 to enable adjustment of the strap across the boot by a rider. In this regard, the binding interface may employ adjustable straps similar to those used on a strap binding. However, it is to be understood that the present invention is not limited to the use of any particular number or type of strap, as numerous other strap arrangements, including arrangements with a single strap or more than two straps, may be employed for securing a boot to the interface, and consequently to the snowboard when the interface is coupled to the binding base. Thus, as used herein, the term strap is intended to indicate any structure that passes over the boot upper and performs this attachment function, including web-like structures, bails and the like.

The interface 24 may include one or more mating features that are adapted to engage with a corresponding strapless engagement member provided on the binding base. As indicated above, the interface 24 is not limited to use with any particular binding base and, therefore, is not limited to the use of any particular mating features for engaging with a binding base. Notwithstanding the foregoing, the interface will be described below in connection with a binding system that employs an attachment configuration wherein strapless engagement members are provided in regions where the straps are attached to the interface. Thus, for an interface including two straps, a four-point attachment configuration is employed for the binding system.

In the illustrative embodiment shown in FIGS. 1–4, the binding interface 24 includes a pair of mating features 34 at a rear or heel end of the interface body and a pair of mating features 36 at the front or toe end of the interface body. As illustrated, each pair of mating features extends outwardly from opposing medial and lateral sides of the interface body 38 so that the mating features are disposed along respective medial and lateral sides of a boot when the interface is mounted to the boot. In this regard, the mating features do not underlie the sole of the boot to ensure that the binding system has a feel similar to that of a strap binding. It is to be appreciated, however, that all embodiments of the present invention are not limited in this manner, as any suitable interface configuration may be employed consistent with a binding base configuration, including the placement of one or any combination of mating features to underlie the snowboard boot.

As indicated above, the interface may employ mating features having any configuration suitable for mating with corresponding engagement members provided on the binding base. In the illustrative embodiment shown in FIGS. 1–4, the interface 24 includes a pair of circular pins 34 extending outwardly from the medial and lateral sides of the heel end of the interface body 38. The circular shape of the pins 34 cam the corresponding engagement members 30 of the binding base open and closed upon stepping out of and into the base. The circular shape also facilitates the displacement of snow, ice and other debris from the engagement members.

The interface 24 further includes a pair of lugs 36 that project outwardly from the medial and lateral sides of the toe end of the interface body. As illustrated, the toe lugs 36 have a generally oval shape with a curved outward facing cam surface 48 (FIGS. 5–5*a*) configured to cam or wedge the corresponding engagement members 32 of the binding base open upon stepping into and out of the binding base. In one embodiment, the cam surface 48 is tapered in the vertical (top-to-bottom) direction and the longitudinal (toe-to-heel) direction to provide the desired wedging action.

It is to be understood that any suitable configuration may be employed for any of the interface mating features, and that all embodiments of the binding interface are not limited to the particular configurations illustrated in this embodiment. It is also to be understood that each of the mating features (e.g., those at the toe and heel ends) may have the same configuration, rather than different configurations as illustrated.

In one embodiment, the interface 24 is configured so that the forces exerted by a rider on the ankle and toe straps are transmitted to the binding in a manner similar to a strap binding, so that the binding system has the performance and feel of a conventional strap system. In the illustrative embodiment shown in FIGS. 1–4, the interface body 38 includes at least one strap attachment point 50 adjacent each of the heel and toe mating features 34, 36 for respectively mounting the ankle and toe straps 40, 42 to the medial and lateral sides of the interface body. In this regard, forces exerted on the straps are transmitted through the mating features 34, 36 and to the binding in a manner similar to a strap binding, wherein the ankle and toe straps are conventionally mounted to the medial and lateral sidewalls of the base. As illustrated, the interface body 38 may include multiple attachment points 50 for each of the ankle and toe straps to provide a rider with a degree of strap adjustability for comfort and/or riding characteristics typically associated with a strap binding.

As discussed above, it is desirable to position the heel and toe mating features 34, 36 adjacent their corresponding strap attachment positions 50 to provide the performance and feel of a strap binding. In this regard, locating the mating features 34, 36 adjacent the strap attachment locations 50 refers to positioning the mating features and the strap attachment locations within the same region of the interface. It is to be understood, however, that this is not a limitation of all embodiments of the invention, and any suitable strap mounting arrangement may be employed with the binding interface in accordance with other embodiments.

Figure 6:
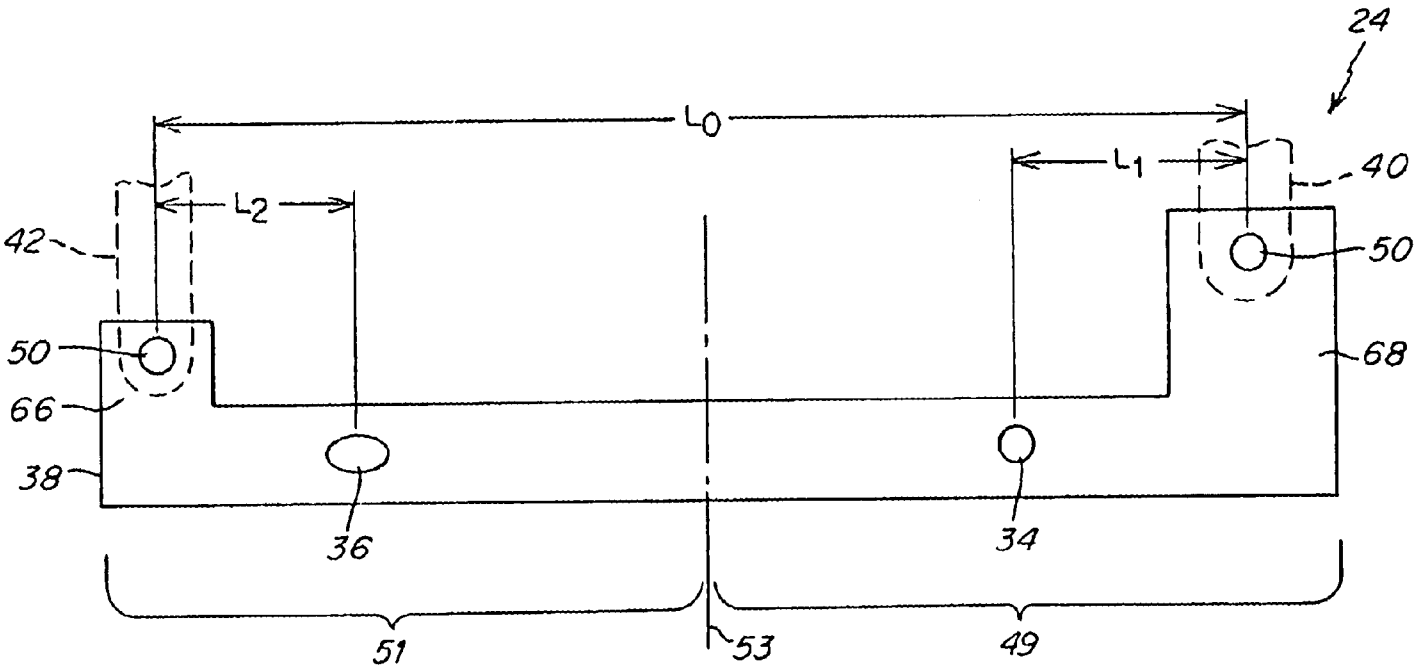
FIG. 6 is a schematic side view of a binding interface illustrating the relative locations between strap attachment points and interface mating features.

As schematically illustrated in FIG. 6, one embodiment of the binding interface 22 includes first and second regions 49, 51 extending in a longitudinal direction along each side of the interface body 38. The first and second regions 49, 51 each includes at least one strap attachment point 50 for one of the first and second straps 40, 42 (e.g., ankle and toe straps). The interface and the binding base are configured so that the strapless engagement mechanism directly engages the interface at each of the first and second regions 49, 51. In one embodiment, the first and second regions are configured so that the interface is engaged by the strapless engagement mechanism on both sides of a mid-point 53 located midway between the strap attachment points 50.

As discussed above, the engagement mechanism is configured to engage first and second mating features provided on the interface body. In the illustrative embodiment, the first mating feature 34 is located in the first region 49 and the second mating feature 36 is located in the second region 51. Each mating feature 34, 36 may be positioned relative to its corresponding strap attachment point 50 to achieve a desired feel.

In the illustrative embodiment of FIG. 6, the relative positions of the mating features 34, 36 to their corresponding strap attachment points 50 are defined by longitudinal distances $L_1$, $L_2$ between the mating feature and its corresponding attachment point. According to one illustrative embodiment, the distance is based on a percentage of the overall distance $L_0$ between the strap attachment points 50 for the first and second straps 40, 42. The distances $L_1$, $L_2$ between the mating features 34, 36 and their corresponding attachment points 50 are preferably less than 50% of the overall distance $L_0$, more preferably within 45% of the overall distance $L_0$, even more preferably within 40% of the overall distance $L_0$, more preferably within 35% of the overall distance $L_0$, even more preferably within 30% of the overall distance $L_0$, more preferably within 25% of the overall distance $L_0$, even more preferably within 20% of the overall distance $L_0$, more preferably within 15% of the overall distance $L_0$, even more preferably within 10% of the overall distance $L_0$, more preferably within 5% of the overall distance $L_0$, and even more preferably the mating features and their corresponding strap attachment points are vertically aligned with each other.

It is to be understood that the above distances between the mating features and strap attachment points are merely exemplary and other distances are possible. For example, although discussed above as a percentage of the overall distance $L_0$ in increments of 5%, the distances $L_1$, $L_2$ between the mating features 34, 36 and their strap attachment points 50 may be any percentage of the overall distance $L_0$, in increments of 1% or any other desirable increment. The relative positions between the mating features and the attachment points may also differ between the first and second regions. For example, the distance $L_1$ between the first mating feature 34 and the attachment point for the first strap 40 may be within 35% of the overall distance $L_0$, while the distance $L_2$ between the second mating feature 36 and the attachment point for the second strap 42 may be within 20% of the overall distance $L_0$. Further, although the mating features are illustrated as being located below or along regions of the interface between the heel and toe strap attachment points, the heel and toe mating features 34, 36 may be located below or along regions of the interface extending beyond the attachment points in the heel and toe directions, respectively.

One desirable characteristic of the binding system 20 (FIGS. 1–4) is its ability to be employed to secure a snowboard boot of any configuration to a snowboard. In this regard, the embodiment shown in the figures employs a universal binding interface 24 that is configured to be mounted to any type of snowboard boot, without requiring that the boot be configured for use with this system.

In the illustrative embodiment shown in FIGS. 1–4, the interface 24 includes a heel strap 52 that is configured to extend about the heel portion of a boot to facilitate proper location of the interface body 38 relative to the boot in the toe-to-heel direction. The opposing ends of the heel strap 52 are mounted to the medial and lateral sides of the heel end of the interface body. In one embodiment, the heel strap is formed from a material having a degree of stiffness such that the heel strap maintains its shape to allow a boot to be stepped into or out of the interface without having to manipulate the heel strap to ensure that it properly engages the boot. For example, the heel strap 52 may be formed from a plastic material, such as a molded polyurethane. It is to be understood, however, that the strap can be formed from any suitable material.

As indicated above, the various mating features may be located on the interface body so that they do not underlie a rider's boot to ensure that the binding system has the feel of a strap binding. In this regard, a rider's boot is generally in direct contact with and rolls across the surface of the base of a strap binding. Consequently, it may be desirable to configure the interface 24 so that at least some portions of a snowboard boot 26, when secured to the binding with the interface, directly engage the binding base to achieve a feel similar to a strap binding.

In one illustrative embodiment shown in FIGS. 1–2, the interface body 38 is configured so that a minimal amount of material is presented below the toe and heel regions of the boot when the interface is mounted to the boot to allow direct contact between the toe and heel regions of the boot with the binding. As illustrated, the lower portion of the interface body 38 which underlies the boot sole includes generally U or V-shaped front and rear edges 54, 56 that converge and diverge toward and away from each other as the edges extend across the width of the interface between the medial and lateral sides of the interface body. This results in an interface body 38 having a lower portion with a generally X shape (e.g., an hourglass or similar shape) that underlies the snowboard boot in which the amount of material below the toe and heel regions of the boot sole decreases as the front and rear edges extend inwardly away from the medial and lateral sides of the interface body. It is to be understood, however, that the interface body 38 is not limited to a hourglass or X shape, as any suitable configuration may be implemented to minimize the amount of material below the toe and heel regions of a boot. Alternatively, in other embodiments, the amount of material does not need to be minimized under the foot, as other configurations are possible.

The lower portion of the interface body includes a central region 58 that underlies the arch portion of the boot and a plurality of arms 60 extending away from the central region to the locations corresponding to the toe and heel portions of a boot for supporting the mating features 34, 36 of the interface at desired locations relative to the boot. As illustrated (FIG. 1), the longitudinal distance $L_3$ between the front and rear mating features 34, 36 along the medial and lateral sides of the interface is greater than the longitudinal distance $L_4$ between the front and rear edges 54, 56 of the interface body as the edges converge toward each other along at least a portion of the lower portion between the medial and lateral sides. In this regard, the front and rear mating features may be located at the toe and heel portions of the boot while reducing the amount of material that underlies the toe and heel portions of the boot. As indicated above, however, the amount of material does not need to be reduced under the boot in all embodiments of the interface.

The central region 58 of the lower portion is provided with an aperture 62 of any shape to further reduce the weight of the interface body. In other embodiments of the interface, however, such an aperture is not employed.

In addition to minimizing the amount of material between the boot and the binding base, the illustrative configuration of the interface also enhances the torsional stability of the interface body. The overall stiffness of the interface 24 is increased, as shown in the illustrative embodiment, with sidewalls 64 that interconnect toe and heel mounting ears 66, 68 along each side of the interface. More particularly, the sidewalls 64 stiffen the interface body in both compression and tension to maintain a fixed distance between the strap attachment points 50 and the heel and toe mating features 34, 36. In one embodiment, the sidewalls 64 are separate components attached to the mounting ears 66, 68. In other embodiments, the sidewalls may be integrally formed with the interface body. It is to be appreciated, however, that the interface body 38 may be configured in any suitable manner to achieve a desired degree of stiffness and/or torsional stability, such that sidewalls are not required for all embodiments.

In a conventional strap binding, the ankle and toe straps are attached to the sidewalls of the binding, and only engage a rider's boot from substantially above the ankle and toe areas. Thus, ankle and toe straps in a strap binding apply forces substantially only in the downward direction to inhibit heel lift and toe lift, respectively, without wrapping around the sides of the boot. Consequently, the ankle and toe straps of a strap binding do not inhibit foot roll within the binding.

As indicated above, it is desirable to configure the binding system 20 so as to provide the performance of a strap binding with the convenience of a step-in system. Thus, according to one illustrative embodiment of the invention, the mounting ears 66, 68 of the interface body may be configured to mount the straps in a manner similar to a conventional strap binding. In this regard, the mounting ears 66, 68 may provide attachment points 50 for the straps at a height and distance apart similar to a strap binding. As illustrated, the mounting ears 66, 68 may be configured to locate the attachment points 50 for the straps in close proximity to the portions of the sidewalls of the binding base where similar straps would be directly attached to the base of a strap binding. This results in forces exerted by a rider on the straps being transmitted to mounting locations similar to a strap binding. The particular configuration and/or location of the mounting ears, however, is not a limitation of all embodiments of the present invention as any suitable configuration or arrangement may be implemented to mount the straps to the interface body.

The interface 24 may be formed from any suitable material or combination of materials to achieve a desired combination of strength, stiffness, weight and the like. For example, the interface body 38 may be formed from a substantially rigid material, such as aluminum, titanium, glass-filled nylon, polycarbonate, thermoplastic polyurethane and the like. The interface mating features 34, 36 will be subjected to significant lifting forces during riding. Thus, it may be desirable to form the mating features from a relatively strong material. For example, the toe and heel mating features may be formed from stainless steel, hardened steel, hardened aluminum or the like to withstand the anticipated lifting forces. It is to be appreciated, however, that the particular materials employed for the interface body and/or mating features may be chosen to achieve any desired performance characteristics.

As indicated above, the interface 24 may be configured as a universal device that may be employed with any snowboard boot. This feature of the present invention is advantageous in that through the use of such a universal interface, any boot can be made compatible with a step-in binding, simply by employing the interface and compatible step-in base of the binding system as described herein. In this manner, a rider can use a boot alone with a strap binding, or the same boot can be used with any of a plurality of different step-in bases by simply employing different interfaces compatible with the desired step-in bases. In other embodiments, the interface may be employed with a boot that has been specifically configured to mate with the interface.

As is to be appreciated, the interface 24 provides a rider with the ability to readily disengage the boots from the binding which may be extremely convenient. For example, a rider may wish to disengage the rear boot from the binding base when advancing along the slope or in a lift line. When it is desired to re-engage the rear boot, the rider can simply step into the binding base, which thereafter engages the interface and secures the boot to the snowboard. In this manner, the interface provides the rider with the convenience of a step-in system, while simultaneously providing the riding performance characteristics of a conventional strap binding due to the use of binding straps to retain the boot to the binding base through the interface. When the rider wishes to get out of the bindings for an extended period, the boots may be disengaged by releasing the straps and stepping out of each binding, similar to a conventional strap binding, with the interface remaining coupled to the binding base.

In another illustrative embodiment shown in FIGS. 7–10, a binding interface 224 may be provided that is similar in many respects to the embodiment of FIGS. 1–4. The interface 224 includes an interface body 38 having a generally hourglass or X shape, similar to the embodiment of FIGS. 1–4 discussed above. In this regard, the interface body 38 includes generally U or V-shaped front and rear edges 54, 56 that converge toward each other as the edges extend inwardly from the medial and lateral sides of the interface. This results in a lack of material below the toe and heel regions of the boot, to enable boot contact with the base to enhance the feel of the binding system to that of a strap binding. The interface also includes sidewalls 64 that are integral with the lower portion of the interface body to enhance the overall stiffness of the interface. A heel strap (not shown) may be mounted to the medial and lateral sides at the heel end of the interface.

The interface 224 includes a pair of circular pins 34 extending outwardly from the sidewalls at the heel end of the interface body. The interface also includes a pair of lugs 36 extending outwardly from the sidewalls at the toe end of the interface body. The pins 34 and lugs 36 are adapted for engagement with the binding base discussed below.

Figure 8:
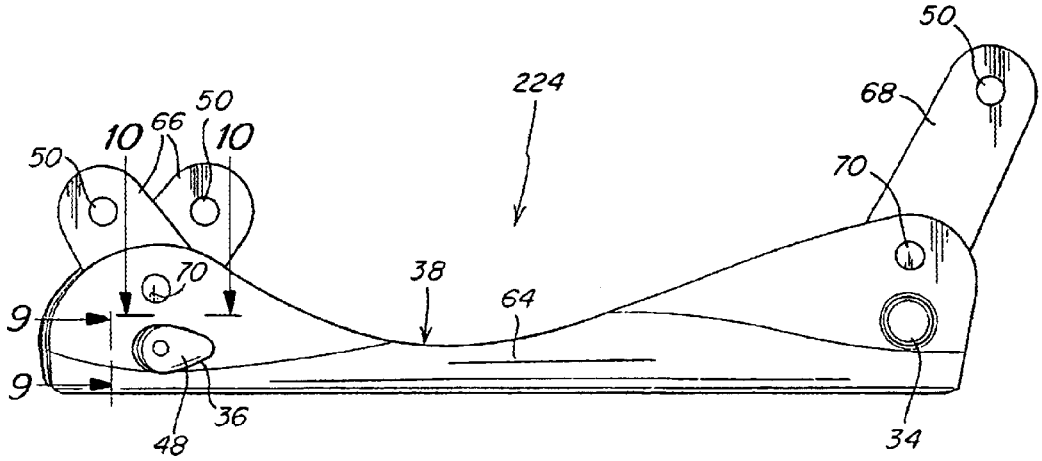
FIG. 8 is a side elevational view of the binding interface of FIG. 7.
Figure 9:
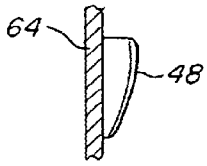
FIG. 9 is a partial, cross-sectional front view taken along section line 9—9 of FIG. 8 illustrating a toe lug of the binding interface of FIGS. 7–8.
Figure 10:
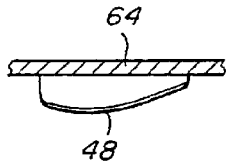
FIG. 10 is a partial, cross-sectional top view taken along section line 10—10 of FIG. 8 illustrating the toe lug of the binding interface of FIGS. 7–9.

As illustrated in FIGS. 8–9, the toe lugs 36 have a generally tear drop shape with a curved outward facing cam surface 48 configured to cam or wedge corresponding engagement members 32 (described below) of the binding base open upon stepping into and out of the binding. Similar to the tapered lugs in the embodiment of FIGS. 1–5 described above, the cam surface 48 is tapered in the vertical direction (FIG. 9) and the longitudinal direction (FIG. 10) to provide the desired wedging action. In contrast to the oval shaped of the lugs in the embodiment of FIGS. 1–5, the tear drop-shaped lugs employ less material to reduce the weight of the toe lugs. As indicated above, however, any suitable configuration may be employed for the interface heel and toe mating features, including configurations to mate with a different type of binding base than that shown in the figures.

The interface 224 also includes a pair of mounting ears 66, 68 for mounting ankle and toe straps (not shown) at the heel and toe ends of the interface body. The upper portion of each mounting ear includes a strap attachment point 50 for attaching a strap. The mounting ears may be adjustably supported by the interface body to selectively locate the strap attachment point 50 for the straps.

Figure 7:
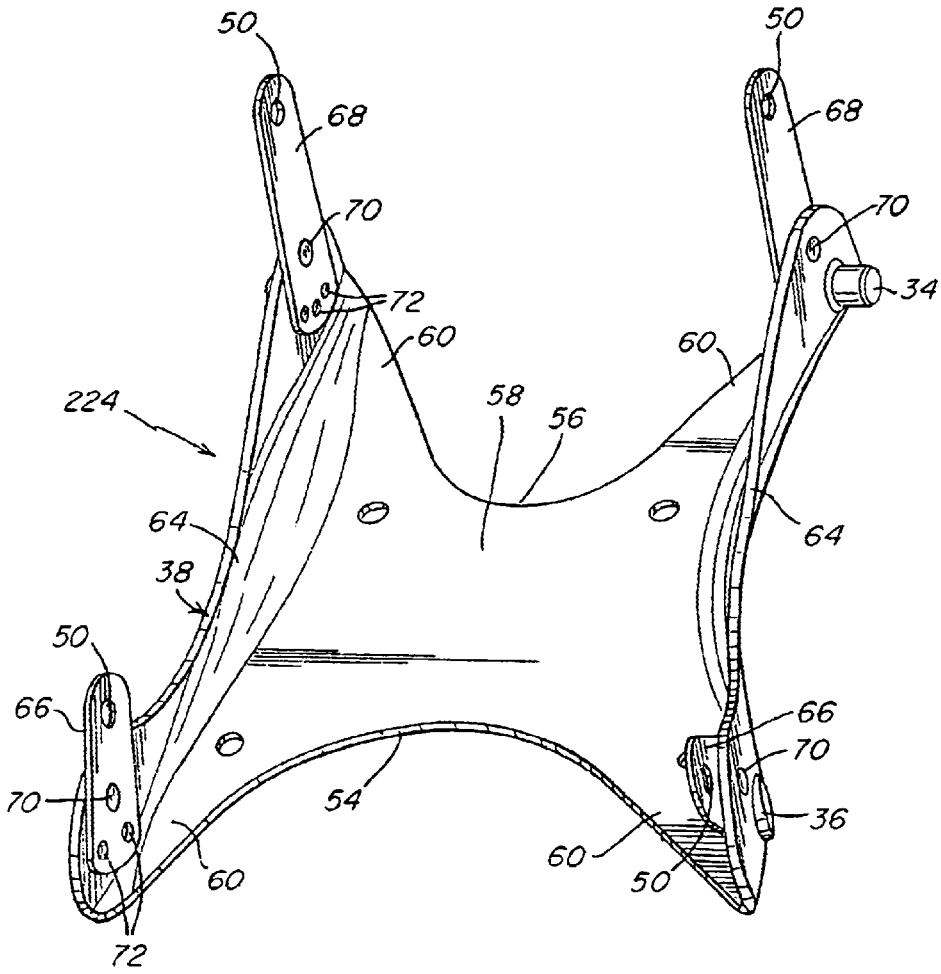
FIG. 7 is a perspective view of another illustrative embodiment of a binding interface for use in a binding system according to the present invention.

In the illustrative embodiment of FIGS. 7–8, the mounting ears 66, 68 are rotatably mounted to the interface body about pivots 70 so that the ears may be oriented at a selected angular position to adjust the strap attachment points. A locking arrangement may be employed to retain the mounting ears in the selected orientation. For example, a detent arrangement 72 may be employed between a lower portion of each mounting ear and the interface body. It is to be appreciated, however, that adjustable mounting ears are optional, and are not needed for all embodiments.

The illustrated binding interfaces described above were described merely for illustrative purposes, as numerous other suitable interfaces may be employed with the binding system.

As discussed above, the interface 24, 224 is not limited to use with any particular mating features 34, 36 for engaging with a step-in binding base. However, one illustrative embodiment of a binding base suitable for use with each of the illustrative configurations of the interface 24, 224 is shown in FIGS. 1–4. It is to be appreciated, however, that other embodiments of the binding system are not limited to use with a strap-mountable interface, as the binding base may be employed to secure a snowboard boot having corresponding mating features provided directly on the boot.

The binding base 22 includes a baseplate 74 that is configured to be mounted to a snowboard using any suitable arrangement, such as a hold down disc 76. A strapless engagement mechanism is provided to secure an interface 24, 224 to the binding base 22. As explained, the interface can be coupled to the base in any number of numerous ways.

The binding includes a highback 78 to provide a rider with heel side support for placing the snowboard on edge for a heel side turn. A heel hoop 80 may be provided at the heel end of the baseplate to be engaged by the highback and to transmit forces applied to the highback to the snowboard. Alternatively, in other embodiments, the highback can be mounted on the interface or boot, or built into the boot.

It should be appreciated that providing the highback 78 on the binding may be more advantageous than providing the highback on the binding interface. For example, a binding interface that is free of a highback is likely to be more comfortable for walking or advancing a board along snow to negotiate a lift line. An interface without a highback generally is lighter compared to an interface having a highback. An interface without a highback may also allow a rider to walk or scoot with a more natural gait as compared to an interface with a highback in which the rider's leg would be held in a forward lean position that, although desirable for riding, may be awkward for walking or scooting. Locating the highback on the binding provides a rider with heel side support only when it is typically desired, when the rider is secured to the board within the binding.

The highback 78 may be mounted to the baseplate 74 for rotation about an axis that is substantially normal to the snowboard to allow a rider to adjust the position of the highback relative to the board edge. In one embodiment, the highback 78 is mounted to the heel hoop 80 using a suitable fastener 82, such as a screw or a tool-free fastener, that extends through an elongated slot 84 on the heel hoop. It is to be appreciated, however, that any suitable arrangement for highback rotation may be implemented, such as employing a series of spaced holes along the heel hoop 80, or other portion of the baseplate, for mounting the highback 78 at desired degrees of rotation. It is to be appreciated that the highback need not be mounted for rotation about the normal axis in all embodiment of the binding base.

In the illustrative embodiment of FIGS. 1–4, the strapless engagement mechanism includes a pair of engagement members 30 at the rear or heel end of the baseplate 74 and a pair of engagement members 32 at the front or toe end of the baseplate 74 that are configured to engage with the corresponding mating features 34, 36 of the binding interface 24, 224. As shown, each of the pairs of engagement members is provided along the opposing sidewalls of the baseplate. It is to be understood, however, that the binding engagement members may be provided at any desired portion of the binding baseplate suitable for engaging with the corresponding mating features of the interface.

Figure 4:
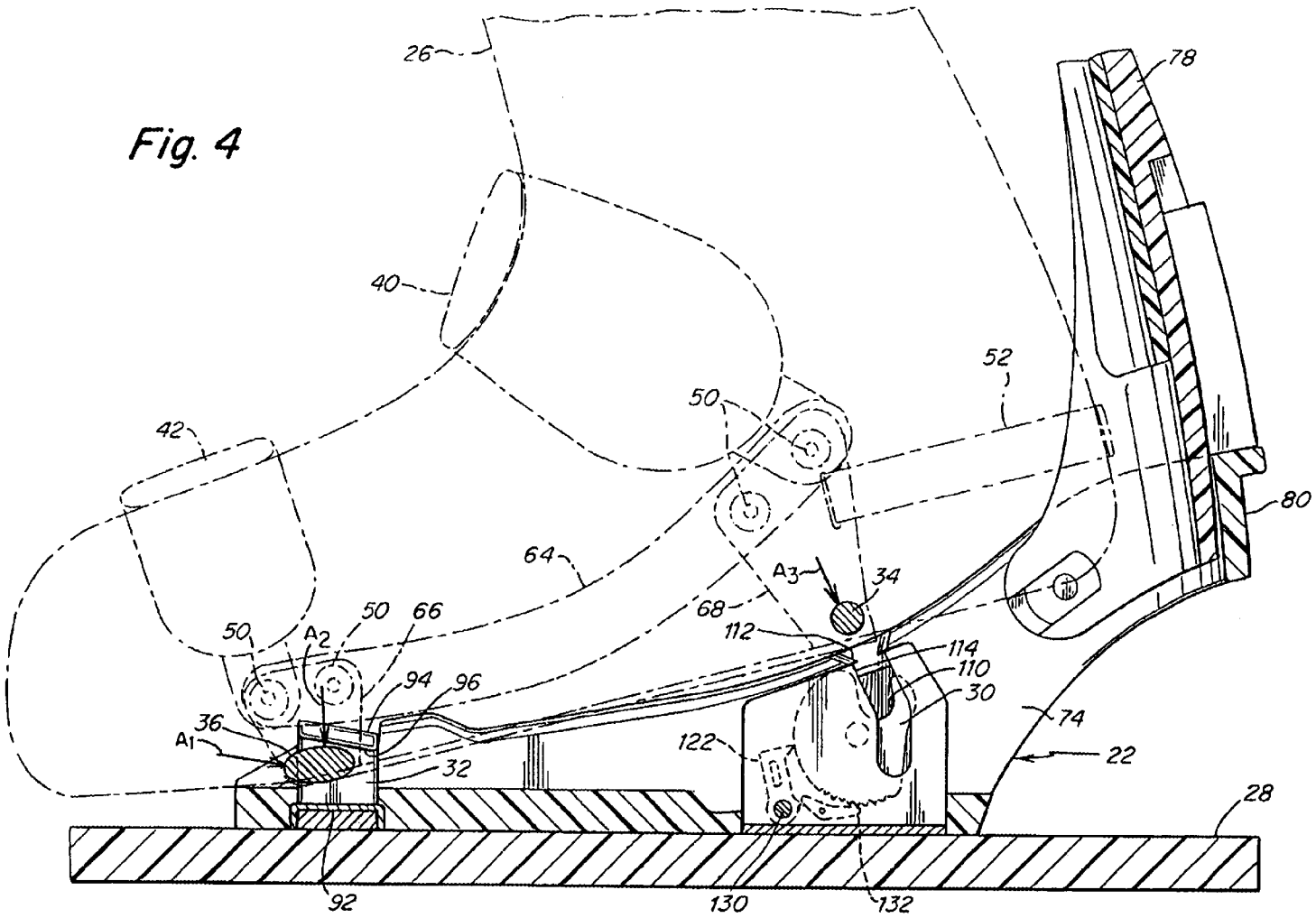
FIG. 4 is a cross-sectional side view of the binding system taken along section line 4—4 of FIG. 2 illustrating the binding interface being stepped into the binding base.

As indicated above, the binding system 20 is configured to provide the convenience of a step-in binding with the riding performance of a strap binding. To that end, the binding 22 may employ one or more engagement members that are configured to operate in a step-in manner. In the illustrative embodiment shown in FIGS. 1–4, the pair of forward or toe engagement members 32 and the pair of rear or heel engagement members 30 are both configured to operate in a step-in manner. To couple the interface with the binding, as shown in FIG. 4, the toe mating features 36 may be either drawn in a rearward direction, as indicated by arrow $A_1$, or stepped in a downward direction, as indicated by arrow $A_2$, into engagement with the toe engagement members 32, and the heel mating features 34 may be stepped in a downward direction, as indicated by arrow $A_3$, into engagement with the heel engagement members 30. The sequence of engaging the interface to the binding base is not a restriction on the present invention, as the toe mating features 36 may be engaged with the binding base before, after, or at approximately the same time as the heel mating features 34 are engaged with the binding base.

In the illustrative embodiment shown in FIGS. 1–4, the binding base employs active toe engagement members 32 which are movable to secure and release the toe mating features 36 of the interface. Actuation of the toe engagement members is accomplished without the use of a handle, button or like actuator, thereby resulting in an automatic toe binding mechanism. In this regard, the binding system employs a toe binding mechanism using an automatic actuation principle similar to that described in commonly owned U.S. Pat. No. 6,099,018. It is to be appreciated, however, that not all embodiments of the binding base are limited to an active mechanism, as non-movable toe engagement members may be employed.

Figure 5:
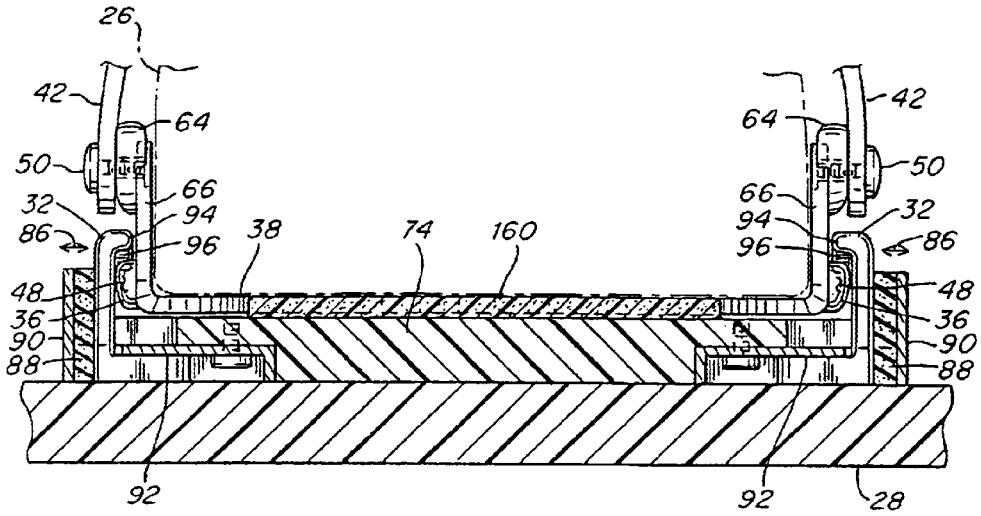
FIG. 5 is a cross-sectional lateral view taken along section line 5—5 of FIG. 3 illustrating a toe mechanism of the binding system.
Figure 5A:
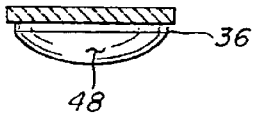
FIG. 5*a* is a partial, cross-sectional top view taken along section line 5*a*—5*a* of FIG. 1 illustrating a toe lug of the binding interface.

In the illustrative embodiment of FIGS. 1–4, the toe engagement members 32 are movably supported on the baseplate 74 between an open or release position to allow the toe mating features to be stepped downwardly into or upwardly out of the binding base and a closed or locked position to engage and secure the toe mating features within the binding base. The toe engagement members 32 include a pair of opposing hook-shaped clips that are configured to move toward and away from each other as they are moved toward the closed and open positions, respectively. In one embodiment, the toe clips 32 are configured to independently move toward and away from each other in the lateral or side-to-side direction 86, as shown in FIG. 5, to facilitate stepping into and out of the binding base. In the illustrative embodiment of FIGS. 1–5, the toe clips 32 are configured to slide in the side-to-side direction 86, although any suitable arrangement may be employed with the binding.

In one illustrative embodiment, as shown in FIG. 5, each toe clip 32 may be urged inwardly towards its closed position with a biasing element 88 disposed between the toe clip 32 and an outer wall 90 of the binding. In this regard, the biasing element 88 may be configured to maintain the toe clips 32 in the closed position with a desired amount of preload on the clips. A stop 92 may be provided to limit the amount of inward deflection of the toe clip under the influence of the biasing element.

The biasing element 88 may include a resilient pad, such as elastomeric pad, placed between the toe clip 32 and the outer wall 90. The pad may also be configured to prevent an accumulation of snow, ice or other debris between the toe clip and outer wall that could otherwise affect operation of the toe clip. It is to appreciated, however, that other biasing elements may be employed with the toe clips, including a spring or other arrangements.

As indicated above, in one illustrative embodiment of the invention, the toe engagement members 32 may include a pair of opposing hook-shaped clips that are movable toward and away from each other. As illustrated in FIG. 4, each clip 32 may include an upper hook portion 94 that is configured with an inclined engagement surface 96 that slopes in a downward direction toward the heel end of the binding, such that the height of the engagement surface 96 above the baseplate 74 is greater at the front side of the clip than at the rear side of the clip. The inclined engagement surface 96 cooperates with the toe mating features 36 of the interface to produce a point contact therebetween to secure the forward end of the interface to the binding base.

The upper hook portion 94 cooperates with the contoured shape of the toe mating features 36 in a wedging or camming manner to automatically open the toe engagement members 32 as the toe end of the interface is stepped into the binding base and the heel end of the interface is lifted out of the binding base. As described above, the toe mating features 36 include a cam surface 48 (FIGS. 5*a* and 9–10) that is tapered in both the vertical direction (top-to-bottom) and the longitudinal direction (toe-to-heel).

The vertical taper results in an overall width between the opposing cam surfaces 48 that decreases in a direction from an upper portion of the mating features toward a lower portion of the mating features. As the toe end of the interface is stepped downward onto the toe engagement members 36, the lower portions of the cam surfaces 48 progressively wedge apart the upper hook portions 94 of the clips until the lugs are seated below the engagement surfaces 96. Once the lugs are positioned below the upper hook portions, the clips return to their closed positions under the biasing force of the biasing elements 88 to secure the toe end of the interface in the binding base.

The longitudinal taper results in an overall width between the opposing cam surfaces 48 that decreases in a direction from the front portion of the toe mating features toward a rear portion of the toe mating features. As the heel end of the interface is lifted out of the binding base, the rear portions of the cam surfaces 48 progressively wedge apart the upper hook portions 94 of the clips until the toe lugs are released from the toe clips. Once the interface is removed from the binding base, the toe clips return to their closed positions under the biasing force of the biasing elements 88 for receiving the interface within the binding base.

Figure 11:
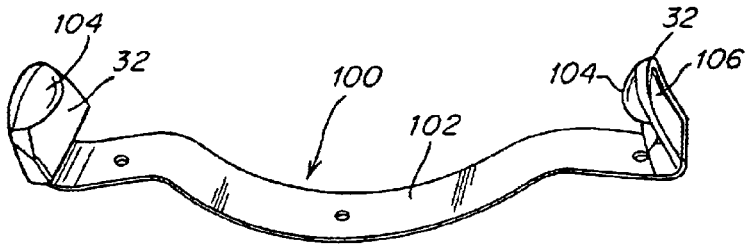
FIG. 11 is a perspective schematic view of another embodiment of a toe mechanism for use with the binding system of the present invention.
Figure 12:
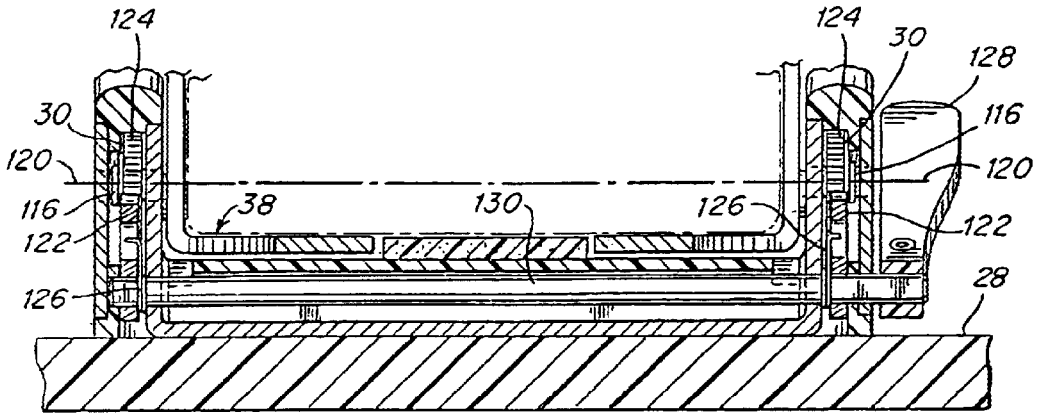
FIG. 12 is a cross-sectional lateral view taken along section line 12—12 of FIG. 3 illustrating a heel mechanism of the binding system of FIGS. 1–4.
Figure 13:
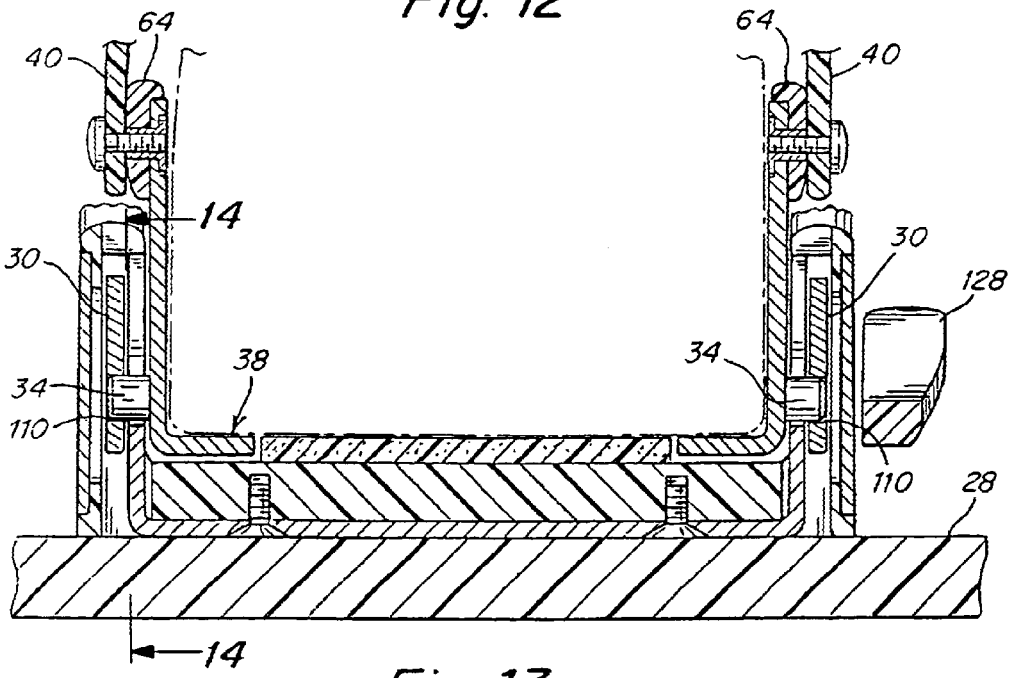
FIG. 13 is a cross-sectional lateral view taken along section line 13—13 of FIG. 3 illustrating the heel mechanism of the binding system of FIGS. 1–4.

In an alternate embodiment shown in FIG. 11, the toe mechanism 100 includes a leaf spring 102 arrangement that underlies and extends across the width of the toe region of the base. A pair of toe engagement members 32 in the form of hook-shaped toe clips are attached to the opposing ends of the leaf spring 102 to be moved in a pivoting manner between open and closed positions in response to a rider stepping into and out of the binding. Each toe clip includes a contoured camming surface 104 that is configured to be engaged and driven apart in a lateral direction by the toe mating features 36 as the interface is stepped into the binding. In a manner similar to the embodiment of FIGS. 1–5 described above, the toe clips 32 are also configured to be wedged apart by the toe mating features 36 as the heel end of the interface is lifted out of the binding.

The toe clips 32 of FIG. 11 have a symmetrical configuration that allows the binding to employ the same toe clip on both sides of the leaf spring for convenience and reduced manufacturing costs. The leaf spring 102 may be formed with upstanding endwalls 106 on which the toe clips are mounted for movement in the lateral direction.

The endwalls 106 may be angled inwardly towards each other to preload the toe clips 32 toward the closed position. In one embodiment, the leaf spring 102 is formed from a spring steel, although it may be formed from any suitable material including, but not limited to, stainless steel.

The configurations of the toe engagement members 32 and the toe mating features 36 achieve an automatic toe locking mechanism that allows a rider to readily step into and out of the binding base without the need to manually actuate a release mechanism for the toe mechanism.

Having described several embodiments of a toe mechanism for securing the toe end of the interface 24 to the binding 22, it should be understood that any suitable toe binding mechanism may be employed with the binding system. In this regard, while an automatic, active arrangement may provide one or more advantages, the binding system 20 is not limited in this respect. For example, the toe mechanism may be coupled to a release mechanism in which the rider manually actuates the toe mechanism to the open and/or closed positions. Alternatively, the toe mechanism may be configured as a non-active arrangement in which the engagement members are non-movable and fixed relative to the binding such that the toe mating features 36 may be moved in a toe-to-heel direction into and out of engagement with the binding by the rider.

One illustrative embodiment of a rear or heel locking mechanism for releasably engaging the rear or heel mating feature of the interface will now be described with reference to FIGS. 1–4 and 12–16. Although the illustrative heel locking arrangement provides a number of advantages as discussed below, it should be appreciated that the present invention is not limited in this respect, and that numerous other heel locking arrangements for engaging with the heel mating features are possible.

In the embodiment shown, the rear locking mechanism includes a pair of engagement members 30 movably supported on the medial and lateral sides of the binding base. In the illustrative embodiment, the engagement members include a pair of engagement cams 30 that are rotatably supported along the sidewalls of the baseplate. Each cam 30 has a receptacle 110 (FIG. 14) that is configured to receive the heel mating feature of the interface. In the illustrative embodiment, the receptacle 110 is configured as an elongated slot adapted to receive a laterally extending pin 34 from the heel end of the binding interface.

In the illustrative embodiment, the heel mechanism includes a guide 112 on each side of the binding baseplate to facilitate alignment between the engagement pin and the corresponding engagement cam. The guide 112 includes a rearward facing ramp surface 114 (FIG. 4) that is inclined rearwardly and downwardly toward the heel end of the binding. As the rider steps down into the binding, the guide 112 draws the engagement pin back along a rearwardly extending path toward the heel end of the binding and into the receptacle 110 of the engagement cam 30, which is aligned with the guide when the engagement cam is placed in the open position.

In the illustrative embodiment, the engagement cams 30 are biased to the open position so that the pin receptacles 110 are oriented in an upwardly facing direction to receive the mating pins 34 being stepped into the binding in a downward direction. In one embodiment, the cams 30 are continuously biased to the open position (counterclockwise as shown by arrow $B_1$ in FIG. 14) using a spring 116, such as a torsion spring disposed about a mounting shaft 118 for the cam. The engagement cams are rotatably mounted about a common transverse axis 120 (FIG. 12) with the engagement cams being parallel to each other to facilitate operation of the heel mechanism. It is to be appreciated, however, that the present invention is not limited to the cams being parallel to each other and/or rotatable about a common axis, as the cams may be mounted along separate axes that may or may not be parallel to each other.

As shown in FIG. 4, the rider can simply step into the binding base by aligning the toe mating features 36 with the forward or toe engagement members 32 on the interface and stepping downwardly so that the toe mating features step into the toe clips and the rear engagement pins 34 are guided by the ramp 114 into the pin receptacle 110 of the engagement cam. As the rider steps further into the binding, engagement between the pin 34 and the lower portion of the cam receptacle 110, which is offset from the cam shaft 118 in a rearward direction, causes the cam to rotate in a rearward direction about the shaft (clockwise in FIGS. 3–4) to a closed position (FIG. 3), where the cam is locked, as discussed below, to secure the pin to the binding base. Alternatively, the cams 30 may be configured with the receptacle 110 offset from the cam shaft 118 in a forward direction so that the cams rotate in a forward direction about the shaft to a closed position.

It should be appreciated that the rearwardly-extending guide 112 is also advantageous because movement of the engagement pin 34 along the guide causes the rider's boot to be drawn rearwardly as the rider steps into the binding base. This causes the rear portion of the boot 26 to advantageously be seated firmly against the heel hoop 80 and highback 78, thereby enabling efficient force transmission between the highback and the boot. This motion positions the forward mating features 36 relative to the forward engagement members 32 to ensure proper engagement by the toe mechanism. It should be understood that the present invention is not limited to the particular guide shown in the figures, as other geometries for a guide are possible to align the interface 24 with the binding 22 and to draw the interface rearwardly into the locked position shown in FIG. 3. In other embodiments, a rearwardly-extending guide need not be employed with the binding base.

In the illustrative embodiment, each engagement cam 30 is rotatably supported by the binding base independently of the other cam. In this manner, each cam 30 may be moved between its open and closed positions independently of the position of the other cam. This may facilitate stepping into and out of the binding base 22 by allowing some misalignment between the interface 24 and binding base 22 as the rider steps into and out of the base. For example, the independent cams 30 may allow a rider to step into or out of the binding base 22 with the interface 24 cocked or angled relative to the lateral and/or medial sides of the base. Although advantageous, it is to be understood that the engagement cams 30 do not need to be mounted for independent rotation in all embodiments of the invention, as the engagement cams 30 alternatively could be coupled to each other for rotation between the open and closed positions.

In the illustrative embodiment shown in FIGS. 14–17, a locking catch 122 is movably supported between an open or release position (FIG. 16) and a closed or locked position (FIG. 15) adjacent the engagement cam to secure the cam it its closed position. The engagement cam 30 includes at least one locking feature 124 that is configured to be engaged by the locking catch 122 when the cam and locking catch are both moved to their locking positions to secure the cam in the locked position. In the illustrative embodiment, the locking catch 122 is rotatable from its open position and to its closed position to engage the cam locking feature 124.

To facilitate operation of the heel mechanism, each locking catch 122 is continuously biased (in the direction of arrow $C_1$) to engage with the engagement cam 30 so that the heel mechanism is automatically actuated into a locked configuration upon rotation of the engagement cam to its closed position to secure the interface to the binding base. A torsion spring 126 (FIG. 14), or other suitable biasing arrangement, may be employed to load the locking catch 122 to its closed or locked position relative to the engagement cam.

Figure 15:
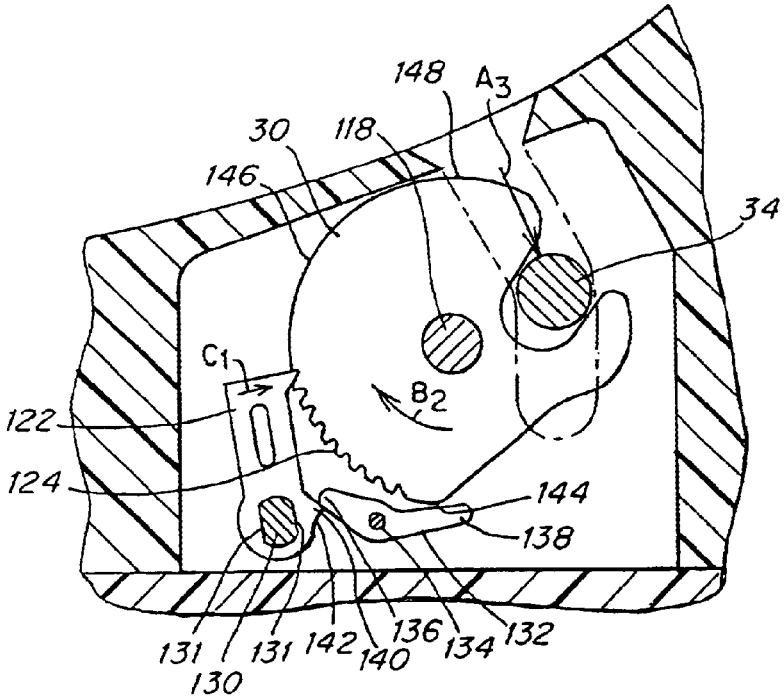
FIG. 15 is a schematic cross-sectional side view of the heel mechanism of FIG. 14 illustrating the heel mating feature being secured by the heel mechanism in an initial closed position.
Figure 16:
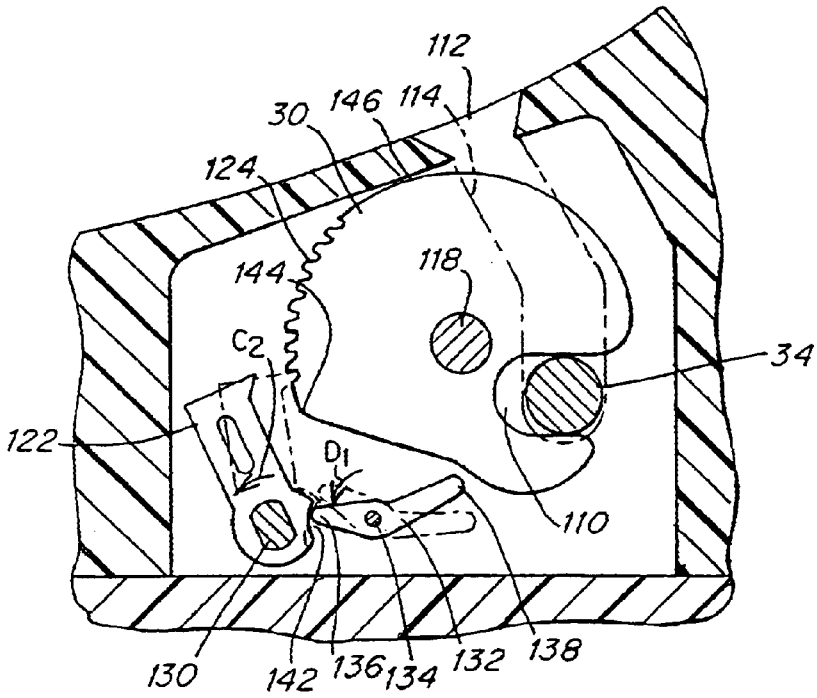
FIG. 16 is a schematic cross-sectional side view of the heel mechanism of FIGS. 12–15 illustrating the heel mating feature being secured by the heel mechanism in a fully closed position.

In one embodiment, the binding system is configured to accommodate an accumulation of snow between the interface/boot and the binding base. In the illustrative embodiment, the heel mechanism is configured with a plurality of locking positions for accommodating varying amounts of snow accumulation on the surface of the baseplate or within the heel mechanism. As shown, the engagement cam includes a plurality of locking features 124, such as locking teeth, that cooperate with the locking catch 122 in a ratchet-and-pawl arrangement. In this manner, the engagement cam 30 may close and secure the engagement pin 34 within any one of a number of locked positions depending upon the amount of snow, ice and/or other debris that may accumulate between the boot and binding base. In this regard, each engagement cam 30 may secure an engagement pin 34 anywhere from a partially closed position (FIG. 15) to a fully closed position (FIG. 16). The amount and degree of cam adjustability may be varied by the number of and pitch between the locking teeth 124 on the engagement cam 30.

The ratcheting arrangement is advantageous in that it allows each engagement cam 30 to continuously and automatically adjust itself toward the fully closed position (FIG. 16) as the accumulation of snow, ice or other debris diminishes between the boot and binding base. For example, as snow and/or ice melts or becomes compressed under the weight of a rider, a downward force exerted by the engagement pin 34 on the engagement cam 30 will further rotate the cam toward its fully closed position, while the locking catch 122 acts as a pawl to prevent the engagement cam 30 from rotating to its open position (FIG. 14) in response to an upward force by the engagement pin on the cam. Additionally, independent rotation of the cams 30, as described above, allows the heel mechanism to accommodate different amounts of snow accumulation on both sides of the binding.

Although advantageous, it is to be understood that a locking arrangement employing multiple locking positions for accommodating snow accumulation does not need to be employed with all embodiments of the present invention. Further, even should it be desirable to accommodate an accumulation of snow, ice or other debris between the boot and binding, it is to be appreciated that other suitable arrangements alternatively may be employed with the heel mechanism and/or toe mechanism of the binding to accommodate such accumulations.

The locking catches 122 may be coupled to a single or separate actuators to allow the rider to release the heel mechanism from its locked position so that the engagement pins of the interface may be removed from the binding. In one illustrative embodiment shown in FIG. 12, the locking catches 122 are coupled to a single release lever 128 using a common shaft or link 130 that extends transversely across the binding between the catches. This arrangement is configured to directly drive the catches 122 from the locked position to a release position upon actuation of the lever by the rider.

In one embodiment, a locking feature is employed to lock the release lever to prevent an inadvertent release of the heel mechanism. For example, a detent arrangement (not shown) may be implemented to prevent inadvertent movement of the lever 128. As another example, a biased lock out button (not shown) may be located adjacent the lever to prevent lever movement until the lock out button is actuated by the rider. It is to be appreciated that the detent and lock out button arrangements are merely exemplary and that any suitable arrangement may be employed for avoiding inadvertent release. Additionally, a locking feature for the lever does not need to be employed in all embodiments.

Each end of the shaft 130 may be configured with a pair of opposing flats 131 (FIG. 15) that cooperate with a corresponding recess in the catch 122 so that rotation of the shaft 130 is transmitted to the catches with little or no rotational slip between the catch and shaft. It is to be appreciated that numerous other configurations may be employed to couple the catches 122 to the shaft 130 so as to minimize rotational slippage therebetween. For example, the shaft may have a hexagonal shape that cooperates with a hexagonal recess in each catch.

While a common shaft 130 provides a relatively simple release arrangement for the catches, it is to be understood that any suitable arrangement may be employed to release the catches from the engagement cams. For example, the catches 122 may be coupled to separate actuators. Additionally, rather than attaching the lever 128 directly to the shaft 130, a linkage may be employed between the lever and shaft to allow the lever to be located to any desired position.

In one embodiment, the heel mechanism includes a cocking mechanism that is configured to maintain the catches in the release position so that the rider is not required to manually hold the catches in the release position while simultaneously stepping out of the binding. In one illustrative embodiment shown in FIGS. 14–17, the cocking mechanism includes a lockout latch 132 that is configured to cooperate with the locking catch 122 in a manner that maintains the catch in its released position to allow rotation of the engagement cam 30 towards the open position to release the engagement pin 34 from the heel mechanism. The lockout latch 132 is rotatably supported about a pivot 134 between a nose or first end 136 of the latch and a tail or second end 138 of the latch. In the illustrative embodiment, the lockout latch 132 is continuously biased toward a lockout position (counterclockwise in the direction of arrow $D_1$ in FIGS. 14–17) so that the latch automatically assumes the lockout position when the catch is placed in its release position. Since the locking catches 122 are coupled to each other, it may be desirable to employ a lockout latch 132 with only one of the catches, although it is to be appreciated that a lockout latch may be employed with each catch.

Figure 14:
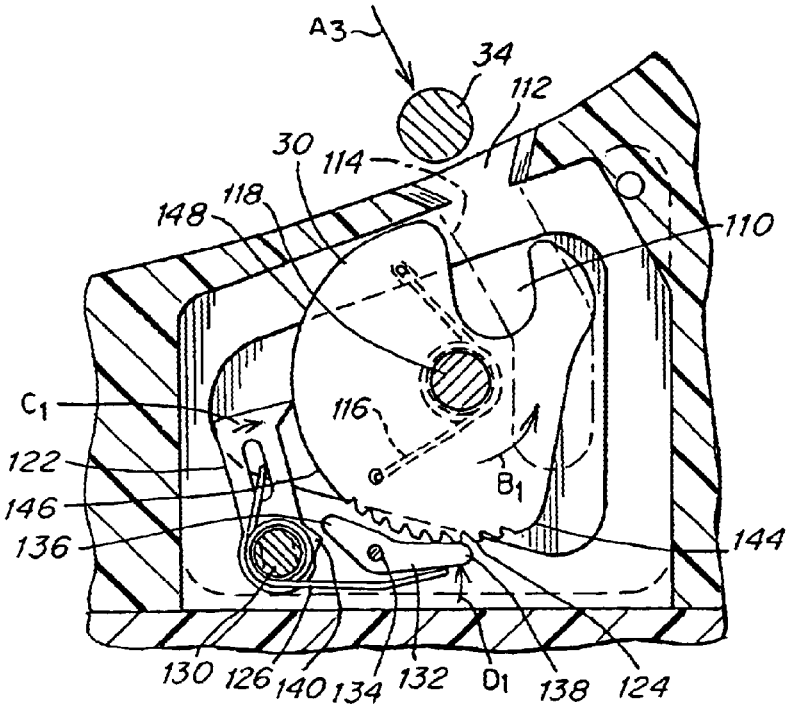
FIG. 14 is a fragmentary, cross-sectional side view of the heel mechanism taken along section line 14—14 of FIG. 13 illustrating a heel mating feature of the binding interface being inserted into the binding heel mechanism in the open position.

In the illustrative embodiment, the nose end 136 of the latch is configured to cooperate with a detent 140 provided on the lower end of the catch 122 to either maintain the catch in the release position or maintain the lockout latch in a neutral position depending upon the desired state of the heel mechanism. As shown in FIG. 15, when the catch 122 is in its locking position to maintain the engagement cam 30 in one of its closed positions, the detent 140 of the catch is positioned below the nose 136 of the lockout latch to maintain the latch in a neutral, non-lockout position. As shown in FIG. 16, when the catch 122 is rotated (in the direction of arrow $C_2$) to its release position by the rider, the lockout latch 132 rotates (counterclockwise $D_1$ in FIG. 16) to its lockout position with the nose end 136 of the latch positioned below the detent 140 of the locking catch. When the rider releases the lever, the lockout latch 132 engages the catch in a notch 142 below the detent to prevent the locking catch 122 from returning to its locked position such that the engagement cam 30 may be freely rotated (counterclockwise $B_1$ in FIG. 14) to its open position as the engagement pin is lifted from the heel mechanism.

Figure 17:
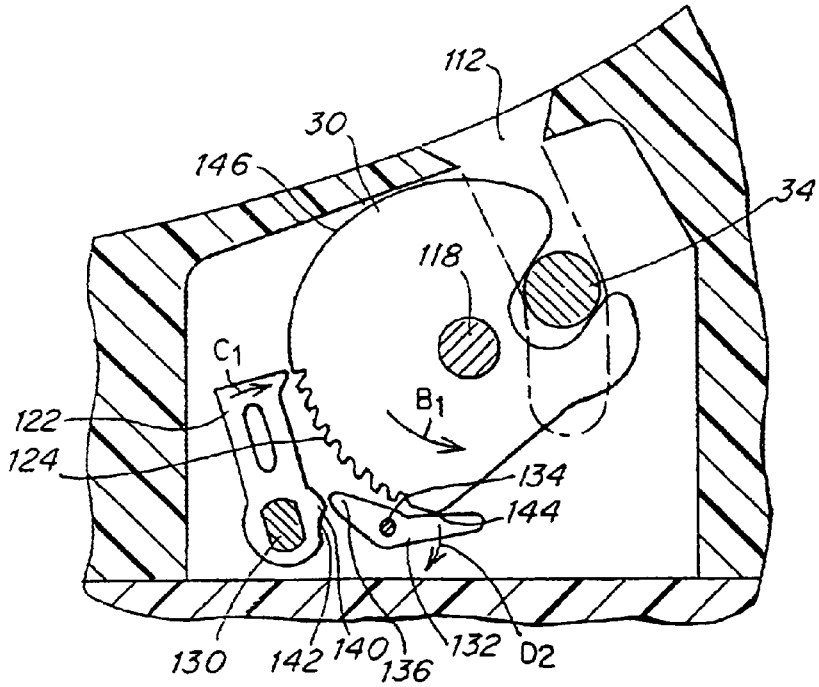
FIG. 17 is a schematic cross-sectional side view of the heel mechanism of FIGS. 12–15 illustrating the heel mating feature being released from the heel mechanism.

The heel mechanism may be configured to be automatically reset when the engagement cam 30 is placed in the open position. In the illustrative embodiment of FIGS. 14–17, the engagement cam 30 includes a trigger 144 that is configured to reset the lockout latch 132 to its neutral position above the detent so that the locking catch 122 may return to a neutral position as shown in FIG. 14. As illustrated in FIG. 17, the trigger 144 is provided along the perimeter of the engagement cam 30 below the locking teeth 124 so that the trigger engages with the tail end 138 of the lockout latch as the engagement cam is rotated (counterclockwise $B_1$ in FIG. 17) to a position in which the locking catch 122 is unable to re-engage with the locking teeth 124 of the cam. Continued rotation of the engagement cam 30 toward the open position causes the lockout latch 132 to rotate (clockwise $D_2$ in FIG. 17) toward its neutral position above the detent 140, thereby allowing the locking catch 122 to assume its reset, neutral position against the cam.

The heel mechanism may employ any suitable cocking arrangement to maintain the catches 122 or other elements in a release position. For example, the cocking mechanism may include a cantilevered lockout, rather than the illustrated rotatable lockout. One such arrangement is described in more detail below.

As described above, the engagement cams of the heel mechanism are supported for independent movement relative to each other between the open and closed positions. It may be desirable to configure the heel mechanism so that neither engagement cam 30 may be locked by its respective locking catch 122 until both engagement cams 30 are placed in a closed position. Such an arrangement may be advantageous in avoiding a false locking condition in which only one of the engagement cams is closed and locked to secure the binding interface to the binding base.

In one illustrative embodiment shown in FIGS. 14–17, the incidence of a false locking condition may be reduced with an arrangement in which each locking catch 122 is maintained in a neutral, non-locked position (FIG. 14) until both engagement cams 30 are actuated to a closed position (FIG. 15). As illustrated, each engagement cam 30 is configured with a neutral region 146 (along the perimeter of the cam above the locking teeth 124) which is configured to be engaged by the locking catch 122 when the cam 30 is in its open position or a neutral position in which the cam is rotated between its open position (FIG. 14) and its initial closed position (FIG. 15). When either of the engagement cams 30 is in the neutral position such that its corresponding locking catch 122 is similarly maintained in the neutral position against the neutral region 146 of the cam, the other locking catch is also maintained in the neutral position, even when its corresponding cam is in a closed position, due to the coupling of the locking catches through the shaft 130. Thus, only when both engagement cams 30 are placed in a closed position (FIG. 15) will each of the locking catches engage any one of the locking teeth 124 on a corresponding cam to lock the cam in one of the closed positions.

It is to be appreciated that the heel mechanism may employ numerous other suitable arrangements to prevent one cam from locking if the other cam is not prepared to lock. In this regard, it is not a limitation of all embodiments to couple the locking catches together. Additionally, other embodiments of the heel mechanism do not need to employ an arrangement to prevent a false locking condition.

Operation of the illustrative embodiment of the heel mechanism shown in FIGS. 1–4 will now be described in connection with FIGS. 14–17. With the engagement cams 30 placed in their open position as shown in FIG. 14, the engagement pins 34 on the interface may be introduced in a downward direction $A_3$ into the heel mechanism. Each pin 34 is directed by the guide 112 in a rearward and downward direction into the pin receptacle 110 of the engagement cam. Continued downward movement of the engagement pin as the rider steps into the binding rotates the engagement cam (clockwise $B_2$ in FIG. 15) toward a closed position.

When each of the engagement cams 30 is rotated to at least an initial closed position as shown in FIG. 15, each locking catch 122 rotates (clockwise $C_1$) into engagement with one of the locking teeth 124 of its corresponding cam. Continued downward movement of the pin 34 further rotates the cam 30 in a ratcheting manner toward a fully closed position, as shown in FIG. 16. It is to be appreciated that any accumulation of snow, ice or other debris between the boot and binding base may result in one or both engagement cams 30 being placed in the initial closed position (FIG. 15) or an intermediate closed position anywhere between the initial closed position and the fully closed position (FIG. 16). Further, either engagement cam 30 may automatically move toward the fully closed position independently of the other cam as any accumulation of snow, ice or other debris is reduced between the boot and binding base.

When it is desired to release the engagement cams 30 to allow a rider to remove the interface from the heel mechanism, the rider actuates the release lever 128 (FIG. 12) to disengage each of the locking catches 122 from its corresponding cam 30 by rotating the catch from its locked position to its release position (FIG. 16). When the locking catches 122 are placed in the release position, the lockout latch 132 rotates in the direction of arrow $D_1$ from its neutral position to the lockout position (FIG. 16) to engage the locking catch in the notch 142 below the detent. In this manner, each locking catch 122 is maintained in a cocked, release position when the rider releases the lever. The rider can thereafter step out of the heel mechanism whenever convenient without being required to hold the release lever while simultaneously stepping out of the heel mechanism.

With the locking catches 122 being maintained in the cocked, release position, the binding interface may be removed from the heel mechanism by lifting the heel end of the interface in an upward direction. As the interface is lifted from the heel mechanism, each engagement pin 34 is raised in an upward direction along the guide 112, thereby allowing the engagement cam 30 to rotate (counterclockwise $B_1$ in FIG. 17) toward its open position. When the cam reaches its neutral position, the trigger 144 engages with and rotates the lockout latch 132 (clockwise $D_2$ in FIG. 17) to its neutral position, thereby releasing the locking catch 122 from its cocked, release position, and enabling the locking latch 122 to move to its neutral position in engagement with the neutral region 146 of the cam as shown in FIG. 14. Thus, removing the binding interface from the binding base automatically resets the heel mechanism for subsequently receiving and securing the binding interface in the binding base.

It may be desirable to provide an indicator that is configured to indicate to a rider that the heel mechanism has been actuated to its closed position to secure the interface to the binding base. The indicator may include one or more visual and/or audible indicators. For example, each engagement cam may include a visual indicator that is configured to indicate to the rider that the cam has been rotated to any one of its closed positions. In one embodiment, a portion of the peripheral edge 148 of the cam between the receptacle and the locking teeth is provided with a contrasting color that becomes visible to the rider when the cam is rotated to at least the initial closed position as shown in FIG. 15. The indicator may be visible through the entrance to the guide 112 or a separate window adjacent the peripheral edge of the cam. It is to appreciated, however, that any suitable indicator, may be employed with the heel and/or toe mechanism of the binding, or an indicator need not be employed at all.

Figure 18:
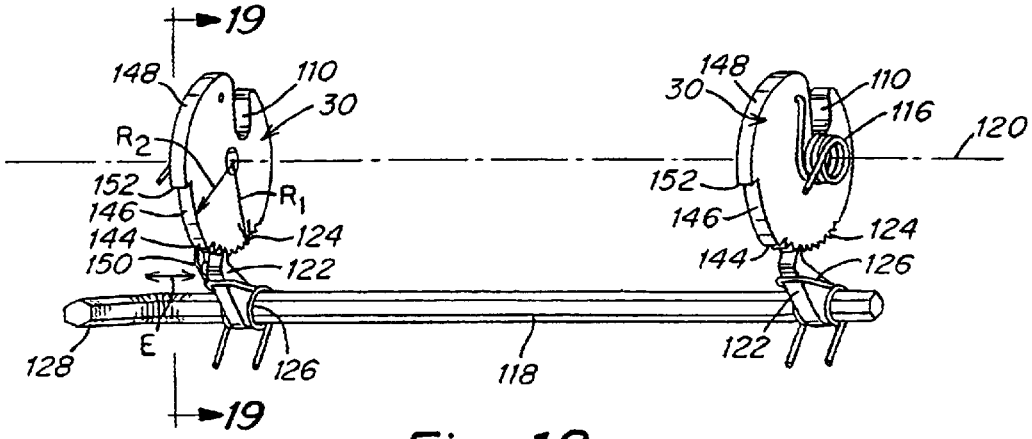
FIG. 18 is a perspective schematic view of another illustrative embodiment of a heel mechanism for use in a binding system according to the present invention.
Figure 19:
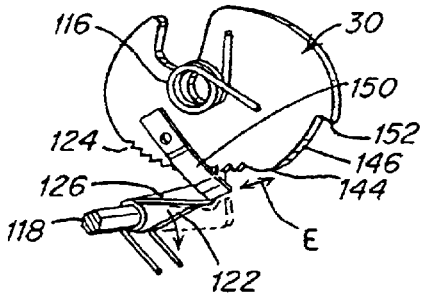
FIG. 19 is a cross-sectional side view taken along section line 19—19 of FIG. 18.

In another illustrative embodiment schematically shown in FIGS. 18–19, a heel mechanism is provided that is similar in many respects to the embodiment described above. The heel mechanism includes a pair of engagement cams 30 that are rotatably supported by the binding base independently of each other for movement between their open and closed positions. Each cam 30 is configured with a receptacle 110 that is adapted to receive the corresponding mating feature, such as a pin, of the interface. The cams 30 are arranged to rotate along a common transverse axis 120 with the cams being parallel to each other, although the cams may be mounted along separate axes that may or may not be parallel. The cams 30 are biased to the open position with a spring 116, such as a torsion spring.

A locking catch 122 is movably supported adjacent each cam 30 between an open or release position and a closed or locked position to engage a locking feature, such as a locking tooth 124, on the cam. The locking catch 122 is biased to the locked position with a torsion spring 126 or other suitable biasing arrangement. To accommodate an accumulation of snow, ice or other debris between the boot/interface and binding base, the catch 122 may engage any of a plurality of locking teeth 124 on the cam 30 in a ratchet-and-pawl arrangement in a manner similar to that described above.

The locking catches 122 are coupled to each other with a common shaft 118 or link that extends transversely across the binding parallel to the rotational axis 120 of the cams. A lever 128 is provided at one end of the shaft 118 to allow a rider to actuate the catches to the open position. As shown, the shaft 118 has a hexagonal shape that cooperates with a hexagonal recess in each catch 122 to minimize rotational slippage.

Similar to the mechanism described above, a cocking mechanism may be employed to maintain the catches in the release position so that a rider is not required to manually hold the catches in the release position while stepping out of the binding. In this illustrative embodiment, the cocking mechanism includes a cantilevered lockout 150, such as a cantilever spring, that is biased to a lockout position between the catch 122 and the cam 30 when the catch is rotated to its release position. The cam 30 includes a trigger 144 between the locking teeth 124 and its neutral region 146 that is configured to engage the free end of the lockout 150 and push the lockout in a lateral direction E to a neutral position against the side of the cam as the engagement cam is rotated toward the open position to reset the mechanism.

As indicated above, each engagement cam 30 is biased to the open position such that when the binding interface is removed from the binding base, the engagement cam will assume its open position, such as shown in FIG. 14. It may be desirable to prevent over-rotation and maintain a pre-load on the cam in the open position so that the cam will not tend to rotate toward the closed position until the interface is stepped into the mechanism. Such an arrangement may facilitate operation of the heel mechanism by ensuring proper positioning of the cams in the open position using a biasing element, such as a spring 116, which exerts a biasing force that would otherwise over-rotate the cams. Alternately, the biasing element could be chosen so that it maintains the cam in the open position when the biasing element attains its relaxed, unloaded state.

In the illustrative embodiment shown in FIGS. 18–19, each cam 30 includes a stop 152 that is configured to be engaged by the locking catch when the cam is rotated to the open position. As illustrated, the cam 30 includes a tooth 152 (along its peripheral edge at an end of the neutral region 146 opposite the locking teeth 124) that is engaged by the locking catch 122 when the cam rotates to the open position. Once engaged, the cam 30 is prevented from over-rotation beyond the open position which may otherwise occur due to the biasing force of the spring. It is to be understood that any other suitable arrangement alternatively may be implemented to maintain each cam in the open position ready to accept the binding interface.

Each cam may be configured with a peripheral edge having a radius that varies between at least the locking teeth 124 and the neutral region 146 relative to the rotational axis 120. As illustrated, the tips of the locking teeth may lie along a radius $R_1$ that is less than the radius $R_2$ of the neutral region. This stepped arrangement maintains a locking catch out of engagement with the locking teeth of a cam rotated to a closed position until both cams are rotated to a closed position. It is to be appreciated that other embodiments of a heel mechanism do not need to employ a cam having a stepped peripheral edge, as any suitable arrangement may be implemented to prevent one side of the heel mechanism from locking unless and until both sides of the mechanism can lock.

Figure 20:
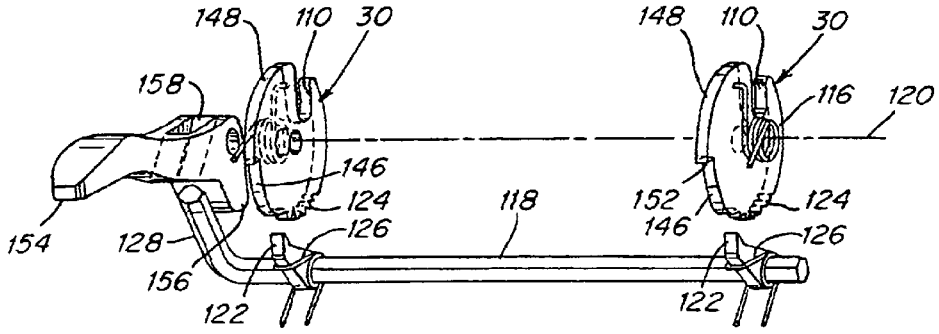
FIG. 20 is a perspective schematic view of a further illustrative embodiment of a heel mechanism for use in a binding system according to the present invention.
Figure 21:
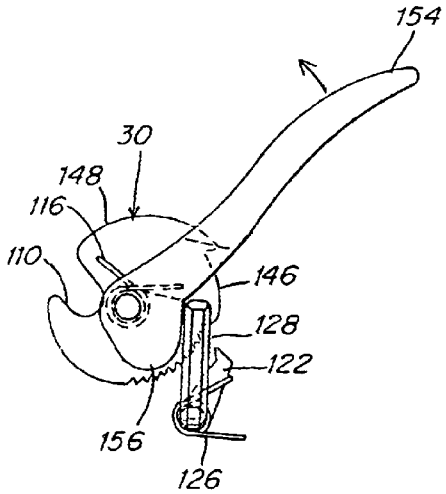
FIG. 21 is a side view of the heel mechanism of FIG. 20 in the release position.
Figure 22:
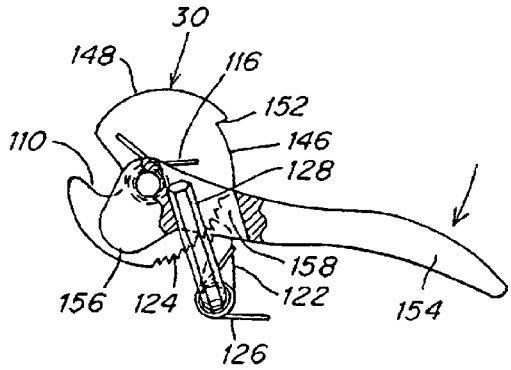
FIG. 22 is a partially fragmented side view of the heel mechanism of FIG. 20 in the locking position.

In a further illustrative embodiment schematically shown in FIGS. 20–22, a heel mechanism may be provided that is similar in many respects to the embodiment described above in FIGS. 18–19. In this embodiment, the heel mechanism also includes a pair of engagement cams 30 that are rotatably supported by the binding independently of each other for movement between their open and closed positions with the cams 30 biased to the open position. A locking catch 122 is movably supported adjacent each cam 30 between an open or release position and a closed or locked position to engage any of a plurality of locking teeth 124 on the cam in a ratchet-and-pawl arrangement to accommodate an accumulation of snow, ice or other debris.

The locking catches 122 are coupled to each other with a common shaft 118 or link that extends transversely across the binding parallel to the rotational axis 120 of the cams. A lever 128 is provided at one end of the shaft 118 which coacts with a separate release handle 154, which is rotatably supported by the binding, to allow a rider to actuate the catches 122 to their open positions.

Similar to the mechanism described above, a cocking mechanism may be employed to maintain the catches in the release position so that a rider is not required to manually hold the catches in the release position while stepping out of the binding. In this illustrative embodiment, the cocking mechanism includes the release handle 154, which is configured with a cam portion 156 that engages with and actuates the lever 128 as the handle is rotated by the rider to a lockout position (FIG. 21). The handle 154 remains in the raised position to maintain the locking catches 122 in the release position when the handle is released to allow the rider to step out of the heel mechanism. The rider may manually reset the heel mechanism by pushing down on the handle 154 (FIG. 22) to allow the lever 128, and consequently the locking catches 122, to return to the locking position.

The handle 154 may be provided with a cavity 158 that is configured to receive the lever 128 when the handle is rotated to the lowered, locking position. This arrangement reduces the incidence of an inadvertent release of the heel mechanism by securing the lever 128 within the handle 154, while allowing limited movement of the lever 128 within the cavity so that the locking catches 122 may operate in a ratcheting manner. As is to be appreciated, any suitable cocking/actuation arrangement may be implemented with the heel mechanism.

Having described several illustrative embodiments of a heel mechanism for the binding base, it should be understood that that binding base may employ any number of suitable heel mechanisms. It is also to be appreciated that any suitable cocking mechanism optionally may be implemented with the illustrated heel mechanisms. Additionally, other embodiments of a heel mechanism do not need to employ a cocking mechanism.

As indicated above, the binding system may be configured to secure snowboard boots of various configurations to a snowboard without requiring any particular modification to the boot. As indicated above, however, it may be desirable for the boot sole to engage the baseplate of the binding. This may be accomplished in any of a number of ways, including several non-limiting examples described below. It is to be appreciated, however, that engagement between the boot sole and the baseplate is not a limitation of all embodiments of the binding system.

Figure 2:
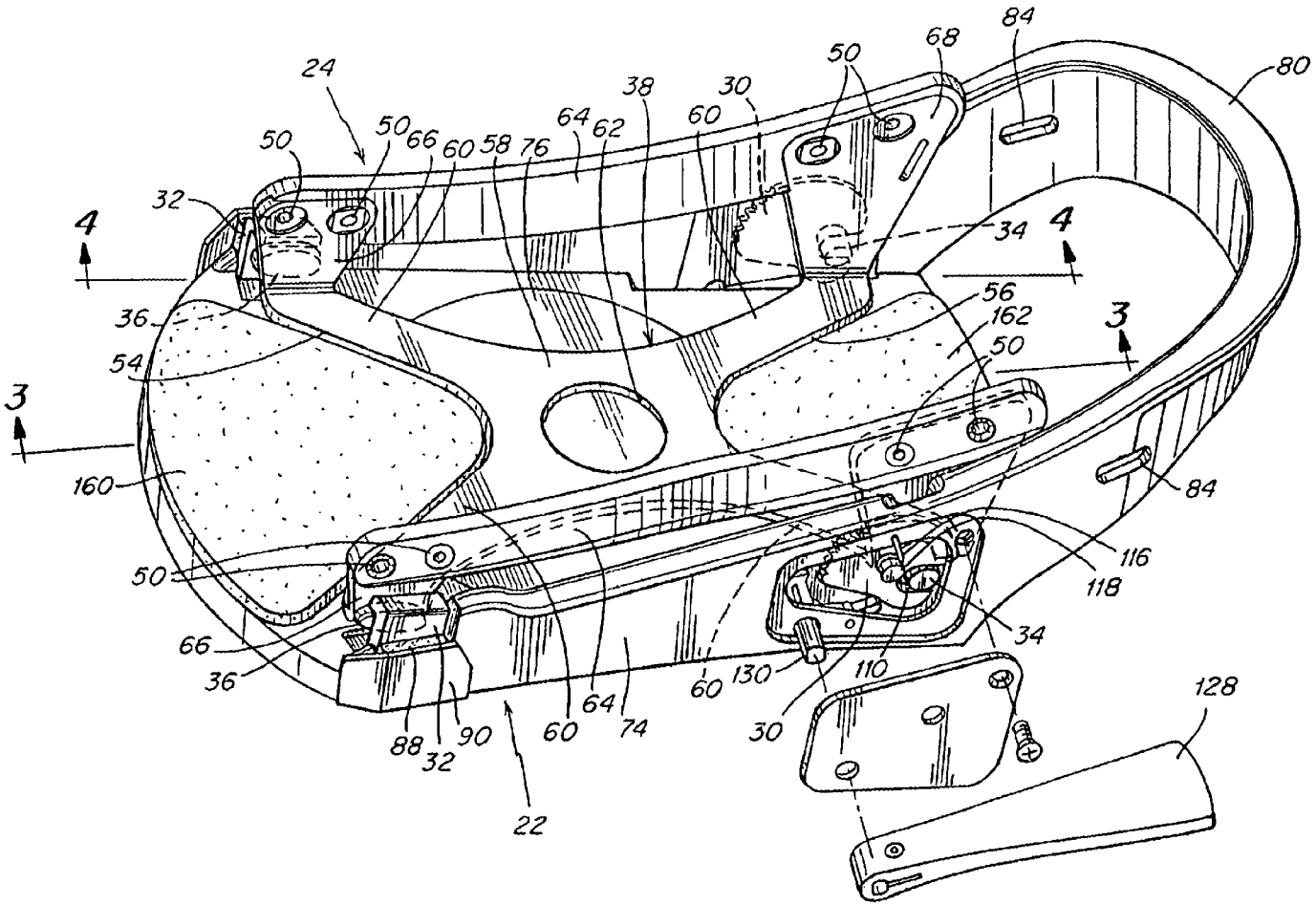
FIG. 2. is a partially exploded perspective view of a binding base and a binding interface of the binding system of FIG. 1, with the straps and highback removed for clarity, illustrating the interface being secured to the binding base.
Figure 3:
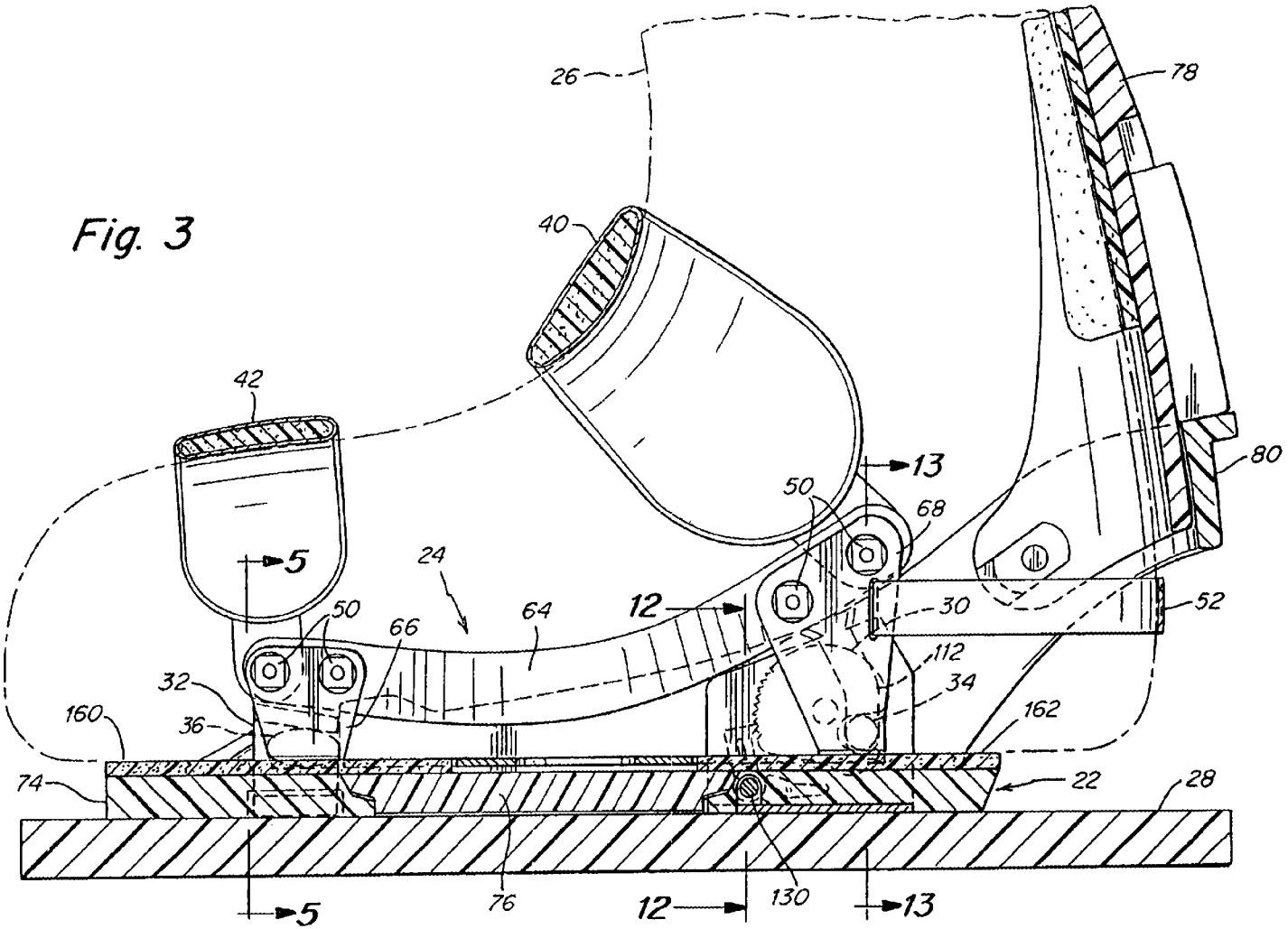
FIG. 3 is a cross-sectional side view of the binding system taken along section line 3—3 of FIG. 2 illustrating the binding interface with a boot fully secured to the binding base.

In one illustrative embodiment shown in FIGS. 1–2, the binding 22 may include one or more pads 160, 162 that are configured to receive the interface body 24 in a nesting relationship to facilitate engagement of the boot sole with the baseplate through the pads. The binding may include toe and heel pads 160, 162 that are configured to underlie the toe and heel regions of the boot 26. The pads 160, 162 may be fixed or adjustable relative to the baseplate 74 to allow a rider to selectively position one or both pads to achieve a desired fit or feel. As illustrated, the pads may be shaped to closely conform to the shape of the front and rear edges 54, 56 of the interface body 38. However, any desirable shape may be implemented with the pads.

Figure 23:
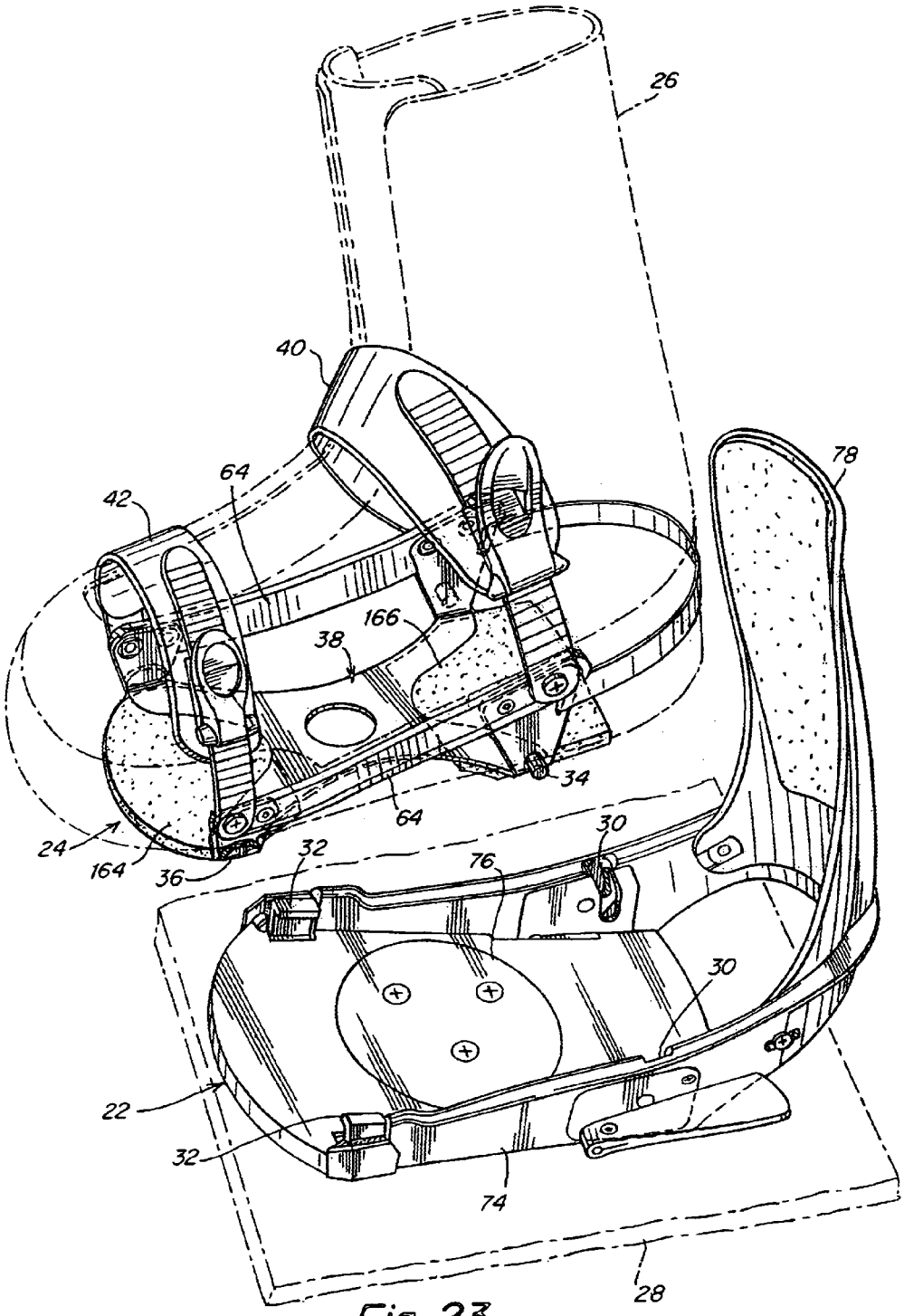
FIG. 23 is an exploded perspective view of a binding system according to another illustrative embodiment of the invention.

In another illustrative embodiment shown in FIG. 23, the interface 24 may include one or more pads 164, 166 attached directly to the lower portion of the interface body 38. The interface may include toe and heel pads 164, 166 that are configured to underlie the toe and heel regions of the boot 26. Engagement between the boot sole and the baseplate 74 is accomplished through the pads when the interface is coupled to the binding base 22.

Figure 24:
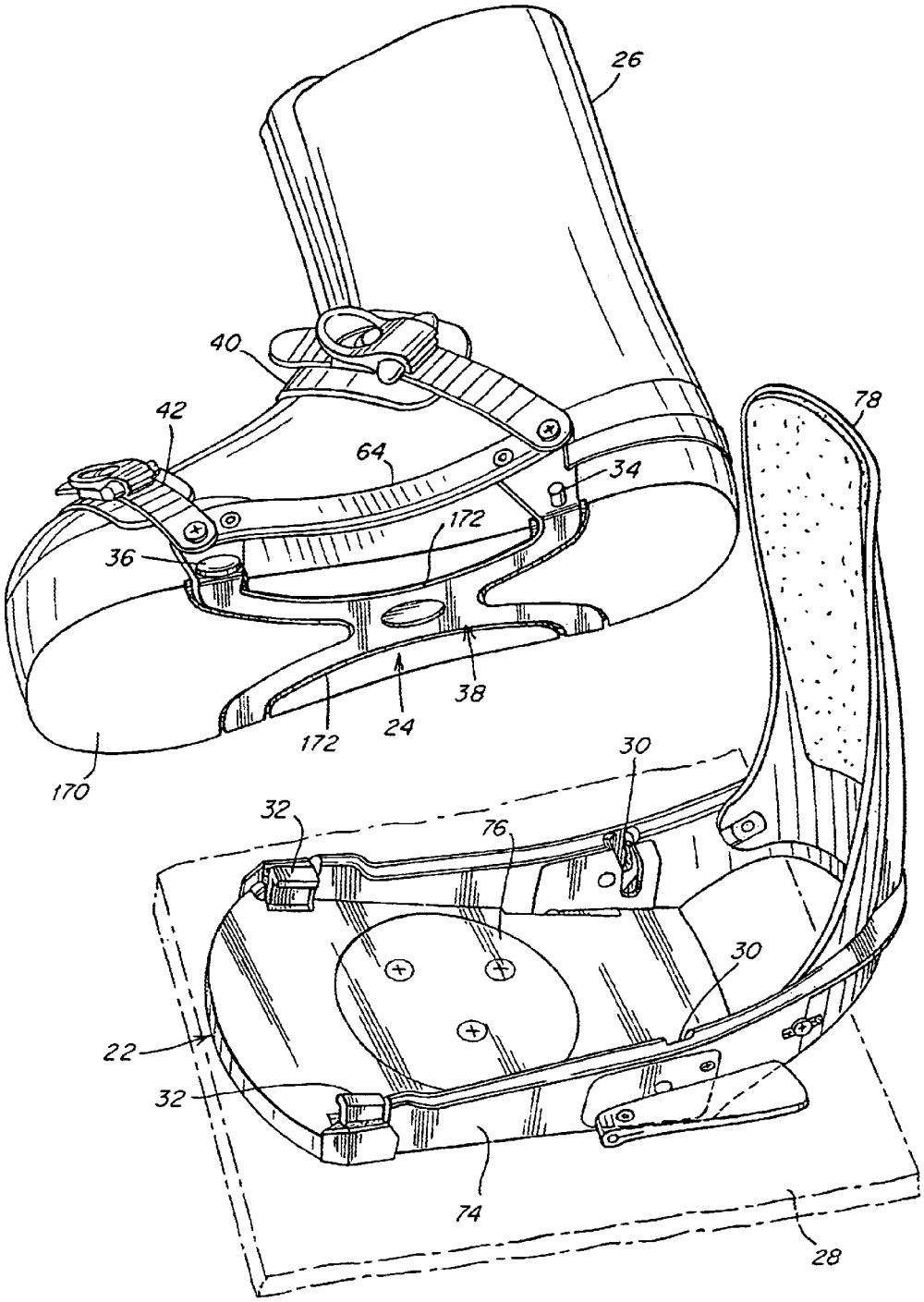
FIG. 24 is an exploded perspective view of a binding system according to a further illustrative embodiment of the invention.

As indicated above, although it may be desirable to employ any snowboard boot with the binding system, the interface may be used with a boot specifically configured for use with the binding system. In one illustrative embodiment shown in FIG. 24, a snowboard boot 26 may include a sole 170 having a recess 172 configured to receive the interface body 38 therein such that the interface body does not protrude below the bottom surface of the sole. This configuration ensures that the boot sole 170 is in direct contact with the binding base 22. In the illustrative embodiment, the recess 172 has a generally hourglass or X shape that is compatible with the interface body. It is to appreciated, however, that the snowboard boot may be configured with a recess in the sole having any desired configuration that may be compatible with the particular shape of the interface.

The interface 24 has been described above in connection with a snowboard binding system for securing a snowboard boot to a snowboard. However, it is also contemplated that the interface 24 may be integrated with other equipment or systems for traversing terrain. For example, in addition to a snowboard binding 22, the interface 24 may be configured to be coupled to a snowshoe, a crampon and the like. In this regard, a rider may employ the same interface for one or more products that may be used for back country riding in which the rider is typically required to hike, climb and ride across various terrain. The interface may be configured with cleats or similar structures to provide a rider with traction to facilitate hiking and climbing terrain.

Having described several illustrative embodiments of the invention, various modifications and improvements will readily occur to those skilled in the art. Such modifications and improvements are intended to be within the scope of the invention. Accordingly, the foregoing description is by way of example only and is not intended to be limiting. The invention is limited only as defined in the following claims and the equivalents thereto.

What is claimed is:

1. A binding system for securing a snowboard boot to a snowboard, the binding system comprising:

a strap mountable binding interface including;

an interface body including medial and lateral sides with first and second regions provided along each of the medial and lateral sides; and first and second straps attached to the first and second regions of the interface body, respectively, the first and second straps being constructed and arranged to extend across first and second portions of the snowboard boot, forward of a heel portion of the boot, to removably secure the binding interface to the snowboard boot; and a snowboard binding base including;

a base body to be mounted to the snowboard, the base body having a heel end and a toe end;

at least one strapless engagement member supported by the base body, the at least one strapless engagement member being constructed and arranged to engage the binding interface at each of the first and second regions of the interface body along both the medial and lateral sides; and a highback supported at the heel end of the base body.

2. The binding system according to claim 1, wherein the first strap includes an ankle strap supported at the first region of the interface body, the ankle strap being constructed and arranged to extend across an ankle portion of the snowboard boot.

3. The binding system according to claim 2, wherein the second strap includes a toe strap supported at the second region of the interface body, the toe strap being constructed and arranged to extend across a toe portion of the snowboard boot.

4. The binding system according to claim 3, wherein the interface body includes a heel end and a toe end, the first and second regions being disposed at the heel end and the toe end thereof, respectively.

5. The binding system according to claim 1, wherein the binding interface further includes a first mating feature supported at each of the first regions along both the medial and lateral sides of the interface body, each of the first mating features adapted to be releasably engaged by the at least one strapless engagement member.

6. The binding system according to claim 5, wherein the binding interface further includes a second mating feature supported at each of the second regions along both of the medial and lateral sides of the interface body, each of the second mating features adapted to be releasably engaged by the at least one strapless engagement member.

7. The binding system according to claim 6, wherein each of the first mating features has a first configuration and each of the second mating features has a second configuration that is different from the first configuration.

8. The binding system according to claim 7, wherein each of the first mating features includes a circular pin extending outwardly from the interface body.

9. The binding system according to claim 8, wherein each of the second mating features includes a lug extending outwardly from the interface body, the lug having a tapered configuration to automatically actuate the at least one engagement member.

10. The binding system according to claim 1, wherein the at least one strapless engagement member is operable between at least one closed position to secure the binding interface to the snowboard binding and an open position to release the binding interface from the snowboard binding.

11. The binding system according to claim 1, wherein the at least one strapless engagement member includes a pair of first engagement members adapted to releasably engage the first regions of the interface body and a pair of second engagement members adapted to releasably engage the second regions of the interface body.

12. The binding system according to claim 11, wherein each of the pair of first engagement members is movably supported by the base body between at least one closed position to engage a corresponding one of the first regions and an open position to release the corresponding one of the first regions.

13. The binding system according to claim 12, wherein each of the pair of first engagement members is rotatably supported at the heel end of the base body.

14. The binding system according to claim 13, wherein each of the pair of first engagement members is rotatable about a transverse axis extending between medial and lateral sides of the base body.

15. The binding system according to claim 13, wherein each of the pair of first engagement members is rotatable independently of the other.

16. The binding system according to claim 13, wherein each of the pair of first engagement members is rotatable from the open position to a plurality of separately lockable closed positions.

17. The binding system according to claim 12, wherein each of the pair of first engagement members is movable from the open position to a plurality of separately lockable closed positions.

18. The binding system according to claim 12, wherein the snowboard binding base further includes a locking mechanism that is constructed and arranged to move between a locking position to maintain each of the pair of first engagement members in the at least one closed position and a release position to permit movement of each of the pair of first engagement members to the open position.

19. The binding system according to claim 18, wherein the snowboard binding base further includes a cocking mechanism that is constructed and arranged to maintain the locking mechanism in the release position.

20. The binding system according to claim 12, wherein each of the pair of first engagement members is continuously biased toward the open position.

21. The binding system according to claim 12, wherein each of the pair of second engagement members is movably supported at the toe end of the base body between a closed position to engage a corresponding one of the second regions and an open position to release the corresponding one of the second regions.

22. The binding system according to claim 21, wherein each of the pair of second engagement members is hook-shaped.

23. The binding system according to claim 22, wherein each of the pair of second engagement members is movable in a lateral side-to-side direction toward and away from the corresponding second regions of the interface body.

24. The binding system according to claim 23, wherein each of the pair of second engagement members is pivotally supported by the base body about separate axes.

25. The binding system according to claim 21, wherein each of the pair of second engagement members is biased toward the closed position.

26. The binding system according to claim 21, wherein each of the pair of second engagement members is movable independently of the other.

27. The binding system according to claim 26, wherein the pair of second engagement members is movable independent of the pair of first engagement members.

28. The binding system according to claim 27, wherein each of the pair of first engagement members is movable independently of the other.

29. The binding system according to claim 21, wherein each of the pair of second engagement members is an active engagement member adapted to automatically move between the open and closed positions in response to the binding interface being stepped into and out of the base body.

30. The binding system according to claim 1, wherein the snowboard binding further includes a guide, supported by the base body, that is adapted to draw the binding interface back toward the heel end of the base body when the binding interface is stepped into the snowboard binding.

31. The binding system according to claim 1, wherein the snowboard binding further includes a heel hoop at the heel end of the base body that is to be engaged by the highback to transmit forces applied to the highback to the base body.

32. The binding system according to claim 1, wherein the base body includes a mounting surface adapted to be mounted to the snowboard, the highback being rotatably mounted to the base body about an axis that is substantially normal to the mounting surface of the base body.

33. The binding system according to claim 1, wherein the first region includes at least one first strap attachment point and the second region includes at least one second strap attachment point, the first and second straps being attached to the first and second strap attachment points, the first and second regions being disposed on opposite sides of a midpoint located midway between the first and second attachment points.

34. The binding system according to claim 33, wherein the first and second strap attachment points are separated by an overall distance in a longitudinal direction along the interface body, the first region including a first mating feature adapted to be engaged by the at least one strapless engagement member and the second region including a second mating feature adapted to be engaged by the at least one strapless engagement member, the first mating feature being separated a first distance in the longitudinal direction from the first strap attachment point and the second mating feature being separated a second distance in the longitudinal direction from the second strap attachment point, each of the first and second distances being less than 50% of the overall distance.

35. The binding system according to claim 34, wherein at least one of the first and second distances is within 40% of the overall distance.

36. The binding system according to claim 35, wherein at least one of the first and second distances is within 30% of the overall distance.

37. The binding system according to claim 36, wherein the at least one of the first and second distances is within 20% of the overall distance.

38. The binding system according to claim 37, wherein the at least one of the first and second distances is within 10% of the overall distance.

39. The binding system according to claim 2, wherein the at least one engagement member includes means for engaging the first and second regions of the interface body.

40. A binding system for securing a snowboard boot to a snowboard, the binding system comprising:

a strap mountable binding interface including;

an interface body;

at least three mating features supported by the interface body; and first and second straps, supported by the interface body, to removably secure the binding interface to the snowboard boot, the first and second straps being constructed and arranged to extend across first and second portions of the snowboard boot forward of a heel portion of the boot; and a snowboard binding base including;

a base body to be mounted to the snowboard, the base body having a heel end and a toe end;

at least three engagement members, supported by the base body, adapted to engage the at least three mating features of the binding interface; and a highback supported at the heel end of the base body.

41. The binding system according to claim 40, wherein the first strap includes an ankle strap supported at a heel end of the interface body, the ankle strap being constructed and arranged to extend across an ankle portion of the snowboard boot.

42. The binding system according to claim 41, wherein the second strap includes a toe strap supported at a toe end of the interface body, the toe strap being constructed and arranged to extend across a toe portion of the snowboard boot.

43. The binding system according to claim 40, wherein each of the at least three engagement members is movably supported by the base body between at least one closed position to engage a corresponding one of the at least three mating features and an open position to release the corresponding one of the at least three mating features.

44. The binding system according to claim 43, wherein the at least three engagement members are movably supported by the base body independently of each other.

45. The binding system according to claim 44, wherein the at least three mating features include a pair of first mating features and a pair of second mating features, and wherein the at least three engagement members include a pair of first engagement members adapted to releasably engage the pair of first mating features and a pair of second engagement members adapted to releasably engage the pair of second mating features.

46. The binding system according to claim 45, wherein each of the pair of first engagement members is rotatably supported by the base body about a transverse axis extending between medial and lateral sides of the base body.

47. The binding system according to claim 46, wherein each of the pair of first engagement members is rotatable from an open position to a plurality of separately lockable closed positions.

48. The binding system according to claim 47, wherein the snowboard binding base further includes a pair of locking members, each of the pair of locking members being movable between a locking position to maintain a corresponding one of the pair of first engagement members in each of the plurality of closed positions and a release position to permit movement of the corresponding one of the pair of first engagement members to the open position.

49. The binding system according to claim 48, wherein the snowboard binding base further includes a cocking mechanism that is constructed and arranged to maintain each of the pair of locking members in the release position.

50. The binding system according to claim 46, wherein each of the pair of first engagement members is continuously biased toward the open position.

51. The binding system according to claim 46, wherein each of the pair of second engagement members is movable in a lateral side-to-side direction from a closed position to an open position.

52. The binding system according to claim 51, wherein each of the pair of second engagement members is automatically movable from the closed position to the open position when the binding interface is stepped into and out of the snowboard binding base.

53. The binding system according to claim 51, wherein each of the pair of second engagement members is hook-shaped.

54. The binding system according to claim 51, wherein each of the second engagement members is pivotally supported by the base body about separate axes that are non-parallel to the transverse axis.

55. The binding system according to claim 51, wherein each of the pair of second engagement members is continuously biased toward the closed position.

56. The binding system according to claim 40, wherein the snowboard binding base further includes a guide, supported by the base body, that is adapted to draw the binding interface back toward the heel end of the base body when the binding interface is stepped into the snowboard binding base.

57. The binding system according to claim 40, wherein the snowboard binding base further includes a heel hoop at the heel end of the base body that is to be engaged by the highback to transmit forces applied to the highback to the base body.

58. The binding system according to claim 40, wherein the base body includes a mounting surface adapted to be mounted to the snowboard, the highback being rotatably mounted to the base body about an axis that is substantially normal to the mounting surface of the base body.

59. The binding system according to claim 45, wherein each of the pair of first mating features has a first configuration and each of the pair of second mating features has a second configuration that is different from the first configuration.

60. The binding system according to claim 59, wherein each of the pair of first mating features includes a circular pin extending outwardly from the interface body.

61. The binding system according to claim 60, wherein each of the pair of second mating features includes a lug extending outwardly from the interface body.

62. The binding system according to claim 61, wherein each lug includes a tapered cam surface adapted to automatically move a corresponding one of the pair of second engagement members from a closed position to an open position.

63. A binding system for securing a snowboard boot to a snowboard, the binding system comprising:

a strap mountable binding interface including;

an interface body having a toe end and a heel end;

a pair of first mating features supported at the heel end of the interface body;

a pair of second mating features supported at the toe end of the interface body; and at least one strap, supported by the interface body, to removably secure the binding interface to the snowboard boot; and a snowboard binding base including;

a base body to be mounted to the snowboard, the base body having a toe end and a heel end;

a pair of first engagement members, each of the pair of first engagement members being movably supported at the heel end of the base body between at least one closed position to engage a corresponding one of the pair of first mating features of the interface and an open position to release the corresponding one of the pair of first mating features;

a pair of second engagement members supported at the toe end of the base body to engage the pair of second mating features of the interface; and a highback supported at the heel end of the base body.

64. The binding system according to claim 63, wherein the at least one strap includes first and second straps supported by the interface body, the first and second straps adapted to extend across first and second portions of the snowboard boot forward of a heel portion thereof.

65. The binding system according to claim 64, wherein the first strap includes an ankle strap supported at the heel end of the interface body, the ankle strap being constructed and arranged to extend across an ankle portion of the snowboard boot.

66. The binding system according to claim 65, wherein the second strap includes a toe strap supported at the toe end of the interface body, the toe strap being constructed and arranged to extend across a toe portion of the snowboard boot.

67. The binding system according to claim 63, wherein each of the pair of first mating features has a first configuration and each of the pair of second mating features has a second configuration that is different from the first configuration.

68. The binding system according to claim 67, wherein the pair of first mating features includes a pair of circular pins extending outwardly from medial and lateral sides of the interface body.

69. The binding system according to claim 68, wherein the pair of second mating features includes a pair of lugs extending outwardly from the medial and lateral sides of the interface body.

70. The binding system according to claim 69, wherein each of the pair of lugs includes an outward facing cam surface that is configured to wedge the pair of second engagement members to an open position.

71. The binding system according to claim 70, wherein the cam surface is tapered in a top-to-bottom direction.

72. The binding system according to claim 70, wherein the cam surface is tapered in a toe-to-heel direction.

73. The binding system according to claim 63, wherein each of the pair of second engagement members is movably supported by the base body between a closed position to engage a corresponding one of the pair of second mating features and an open position to release the corresponding one of the pair of second mating features.

74. The binding system according to claim 73, wherein the pair of second mating features is adapted to automatically move the pair of second engagement members when the binding interface is stepped into and out of the snowboard binding base.

75. The binding system according to claim 73, wherein each of the second engagement members is movable in a lateral side-to-side direction.

76. The binding system according to claim 75, wherein each of the second engagement members is hook-shaped.

77. The binding system according to claim 76, wherein each of the second engagement members is pivotally supported by the base body about separate axes.

78. The binding system according to claim 73, wherein each of the pair of second engagement members is movable independently of the other.

79. The binding system according to claim 73, wherein each of the pair of second engagement members is continuously biased to the closed position.

80. The binding system according to claim 63, wherein each of the pair of first engagement members is rotatably supported by the base body.

81. The binding system according to claim 80, wherein each of the pair of first engagement members is rotatable about a transverse axis extending between medial and lateral sides of the base body.

82. The binding system according to claim 81, wherein each of the pair of first engagement members is rotatable independently of the other.

83. The binding system according to claim 82, wherein each of the pair of first engagement members is rotatable from its open position to a plurality of closed positions.

84. The binding system according to claim 82, wherein the snowboard binding base further includes a pair of locking members, each of the pair of locking members is moveable between a locking position to maintain a corresponding one of the pair of first engagement members in the at least one closed position and a release position to permit movement of the corresponding one of the pair of first engagement members to the open position.

85. The binding system according to claim 84, wherein the snowboard binding base further includes a cocking mechanism that is constructed and arranged to maintain each of the pair of locking members its release position.

86. The binding system according to claim 63, wherein each of the pair of first engagement members is continuously biased toward the open position.

87. The binding system according to claim 86, wherein the snowboard binding base further includes at least one stop that is constructed and arranged to prevent over-rotation of the pair of first engagement members beyond their open positions.

88. The binding system according to claim 63, wherein the snowboard binding base further includes a guide, supported by the base body, that is adapted to draw the binding interface back toward the heel end of the base body when the binding interface is stepped into the snowboard binding base.

89. The binding system according to claim 63, wherein the snowboard binding base further includes a heel hoop at the heel end of the base body that is to be engaged by the highback to transmit forces applied to the highback to the base body.

90. The binding system according to claim 63, wherein the base body includes a mounting surface adapted to be mounted to the snowboard, the highback being rotatably mounted to the base body about an axis that is substantially normal to the mounting surface of the base body.

91. A binding system for securing a snowboard boot to a snowboard, the binding system comprising:

a strap mountable binding interface including;

an interface body having a toe end, a heel end and lateral and medial sides;

a pair of first mating features, one each supported along the lateral and medial sides of the interface body;

a pair of second mating features, one each supported along the lateral and medial sides of the interface body; and at least one strap supported by the interface body to removably secure the binding interface to the snowboard boot; and a snowboard binding base including:

a base body to be mounted to the snowboard, the base body having lateral and medial sides;

a pair of first engagement members, one each movably supported along the lateral and medial sides of the base body between at least one closed position to engage a corresponding one of the pair of first mating features of the interface and an open position to release the corresponding one of the pair of first mating features;

a pair of second engagement members that are independent of the pair of first engagement members, one each of the pair of second engagement members supported along the lateral and medial sides of the base body, each of the pair of second engagement members adapted to engage a corresponding one of the pair of second mating features of the interface; and a highback supported at the heel end of the base body.

92. The binding system according to claim 91, wherein the at least one strap includes first and second straps supported by the interface body, the first and second straps adapted to extend across first and second portions of the snowboard boot forward of a heel portion thereof.

93. The binding system according to claim 92, wherein the first strap includes an ankle strap adapted to extend across an ankle portion of the snowboard boot.

94. The binding system according to claim 93, wherein the second strap includes a toe strap adapted to extend across a toe portion of the snowboard boot.

95. The binding system according to claim 91, wherein each of the pair of first mating features has a first configuration and each of the pair of second mating features has a second configuration that is different from the first configuration.

96. The binding system according to claim 95, wherein the pair of first mating features includes a pair of circular pins extending outwardly from the medial and lateral sides of the interface body.

97. The binding system according to claim 96, wherein the pair of second mating features includes a pair of lugs extending outwardly from the medial and lateral sides of the interface body.

98. The binding system according to claim 97, wherein each of the pair of lugs includes an outward facing cam surface that is configured to wedge the pair of second engagement members to an open position.

99. The binding system according to claim 98, wherein the cam surface is tapered in a top-to-bottom direction.

100. The binding system according to claim 98, wherein the cam surface is tapered in a toe-to-heel direction.

101. The binding system according to claim 91, wherein each of the pair of second engagement members is movably supported by the base body between a closed position to engage a corresponding one of the pair of second mating features and an open position to release the corresponding one of the pair of second mating features.

102. The binding system according to claim 101, wherein the pair of second mating features is adapted to automatically move the pair of second engagement members when the binding interface is stepped into and out of the snowboard binding base.

103. The binding system according to claim 101, wherein each of the second engagement members is movable in a lateral side-to-side direction.

104. The binding system according to claim 103, wherein each of the second engagement members is hook-shaped.

105. The binding system according to claim 104, wherein each of the second engagement members is pivotally supported by the base body about separate axes.

106. The binding system according to claim 101, wherein each of the pair of second engagement members is movable independently of the other.

107. The binding system according to claim 101, wherein each of the pair of second engagement members is continuously biased to the closed position.

108. The binding system according to claim 91, wherein each of the pair of first engagement members is rotatably supported by the base body.

109. The binding system according to claim 108, wherein each of the pair of first engagement members is rotatable about a transverse axis extending between medial and lateral sides of the base body.

110. The binding system according to claim 109, wherein each of the pair of first engagement members is rotatable independently of the other.

111. The binding system according to claim 110, wherein each of the pair of first engagement members is rotatable from the open position to a plurality of separately lockable closed positions.

112. The binding system according to claim 110, wherein the snowboard binding base further includes a pair of locking members, each of the locking members being moveable between a locking position to maintain a corresponding one of the pair of first engagement members in the at least one closed position and a release position to permit movement of the corresponding one of the pair of first engagement members to the open position.

113. The binding system according to claim 112, wherein the snowboard binding further includes a cocking mechanism that is adapted to maintain each of the pair of locking members in its release position.

114. The binding system according to claim 91, wherein each of the pair of first engagement members is continuously biased toward the open position.

115. The binding system according to claim 114, wherein the snowboard binding base further includes at least one stop that is constructed and arranged to prevent over-rotation of each of the pair of first engagement members beyond its open position.

116. The binding system according to claim 91, wherein the snowboard binding base further includes a guide, supported by the base body, that is adapted to draw the binding interface back toward the heel end of the base body when the binding interface is stepped into the snowboard binding base.

117. The binding system according to claim 91, wherein the snowboard binding base further includes a heel hoop at the heel end of the base body that is to be engaged by the highback to transmit forces applied to the highback to the base body.

118. The binding system according to claim 91, wherein the base body includes a mounting surface adapted to be mounted to the snowboard, the highback being rotatably mounted to the base body about an axis that is substantially normal to the mounting surface of the base body.

* * * * *